US011532191B2

(12) United States Patent
Johnson

(10) Patent No.: US 11,532,191 B2
(45) Date of Patent: Dec. 20, 2022

(54) INTERLOCK SYSTEM AND PARTS THEREOF

(71) Applicant: Fortress Interlocks Limited, Wolverhampton (GB)

(72) Inventor: Robert Johnson, Wolverhampton (GB)

(73) Assignee: Fortress Interlocks Limited, Wolverhampton (GB)

( * ) Notice: Subject to any disclaimer, the term of this patent is extended or adjusted under 35 U.S.C. 154(b) by 1151 days.

(21) Appl. No.: 16/079,780

(22) PCT Filed: Feb. 24, 2017

(86) PCT No.: PCT/GB2017/050507

§ 371 (c)(1),
(2) Date: Aug. 24, 2018

(87) PCT Pub. No.: WO2017/144917

PCT Pub. Date: Aug. 31, 2017

(65) Prior Publication Data

US 2019/0051077 A1 Feb. 14, 2019

(30) Foreign Application Priority Data

Feb. 26, 2016 (GB) ..... 1603337

(51) Int. Cl.
*G07C 9/00* (2020.01)
*E05B 49/00* (2006.01)

(52) U.S. Cl.
CPC ..... *G07C 9/00722* (2013.01); *E05B 49/002* (2013.01); *G07C 9/00174* (2013.01);
(Continued)

(58) Field of Classification Search
CPC ..... G07C 9/00722; G07C 9/00174; G07C 9/00309; G07C 9/00857; G07C 9/00904;
(Continued)

(56) References Cited

U.S. PATENT DOCUMENTS 4,642,631 A * 2/1987 Rak ..... G07C 9/33 361/172
5,745,044 A * 4/1998 Hyatt, Jr. ..... G07B 15/00 340/5.23

(Continued)

FOREIGN PATENT DOCUMENTS

EP 0780531 A1 6/1997
EP 0784139 A1 7/1997

(Continued)

OTHER PUBLICATIONS

International Searching Authority, "International Search Report and Written Opinion," issued for PCT/GB2017/050507, dated Jun. 16, 2017 (16 pages).

(Continued)

*Primary Examiner* — Edwin C Holloway, III
(74) *Attorney, Agent, or Firm* — Loeb & Loeb LLP

(57) ABSTRACT

An interlock system comprising: a first lock including a first lock memory configured to store one or more virtual keys; and a first key including a first key memory configured to store one or more virtual keys, wherein the first lock is configured to be actuated between a first condition and a second condition, when a first virtual key stored in the first key memory is transferred to the first lock memory, by engagement of the first key and first lock, and movement of the first key with respect to the first lock.

19 Claims, 18 Drawing Sheets

(52) U.S. Cl.
CPC ..... *G07C 9/00309* (2013.01); *G07C 9/00857* (2013.01); *G07C 9/00904* (2013.01); *G07C 2009/00992* (2013.01)

(58) Field of Classification Search
CPC ..... G07C 2009/00992; G07C 9/00658; G07C 2009/00753; E05B 49/002; G05B 2219/14118; H01H 47/001; H01H 9/20; H01H 9/22; H01H 9/045; F16H 2061/223
USPC ..... 340/5.2
See application file for complete search history.

(56) References Cited

U.S. PATENT DOCUMENTS 6,046,680 A * 4/2000 Soenen ..... G08C 19/28 340/5.31
6,442,985 B1 9/2002 Watanuki et al.
7,311,247 B1 * 12/2007 Lenner ..... G07C 9/00896 235/380
2004/0207509 A1 * 10/2004 Mlynarczyk ..... G07C 9/00817 340/5.23
2007/0131005 A1 * 6/2007 Clare ..... G07C 9/00309 340/13.24
2008/0066507 A1 * 3/2008 Trempala ..... E05B 47/00 70/283.1
2012/0206235 A1 * 8/2012 Jin ..... E05B 47/0611 340/5.64
2016/0371908 A1 * 12/2016 Dow ..... F16P 3/147

FOREIGN PATENT DOCUMENTS

EP 1703045 A1 9/2006
FR 2801334 A1 5/2001
WO 01/55539 A1 8/2001
WO 02/29188 A1 4/2002

OTHER PUBLICATIONS

UK Intellectual Property Office, "Search Report," issued for GB1603337.5, dated Sep. 2, 2016 (5 pages).

* cited by examiner

INTERLOCK SYSTEM AND PARTS THEREOF

CROSS-REFERENCE TO RELATED APPLICATIONS

This application is a national stage application, filed under 35 U.S.C. 371, of International Patent Application No. PCT/GB2017/050507, entitled "AN INTERLOCK SYSTEM AND PARTS THEREOF", filed on Feb. 24, 2017, which claims the benefit of United Kingdom patent application No. 1603337.5, entitled "AN INTERLOCK SYSTEM AND PARTS THEREOF", filed on Feb. 26, 2016, the disclosures of which are hereby expressly incorporated by reference herein in their entirety.

TECHNICAL FIELD

Embodiments of the present invention relate to interlock systems, parts thereof and safety systems including interlock systems. In particular, some embodiments of the present invention relate to an interlock system which replicates the functionality of a trapped key interlock using virtual keys.

BACKGROUND

Trapped key interlocks are used to lock access means to industrial areas and hazardous equipment and/or to ensure that a particular sequence of operations is followed. For example, the sequence may be such that the hazardous area is rendered safe to enter before the door can be opened. The hazardous area may contain a mechanical or electrical device or the like, which is shut down when the door is unlocked, and cannot resume functioning until the door is securely locked again, by way of the interlock system.

Trapped key interlocks define the sequence which needs to be followed in a mechanical manner—trapped key interlocks are operated by one or more keys, which are trapped and released in a predetermined order to create the sequence.

The sequences required to operate trapped key interlocks, which may include a number of separate keys and locks, may be confusing to some users. This can result in safety issues arising if the incorrect sequences are attempted by a user, and can result in a user becoming frustrated with the interlock and attempting to bypass it.

Both the keys and locks of common trapped key interlocks are bespoke when manufactured, such that the key and lock are correctly mutually coded in a substantially unique manner (i.e. so that they fit one another and would not operate correctly with another key or lock). Bespoke manufacture may be costly and any changes to a bespoke lock and key may be difficult to implement. Lost or damaged keys are difficult to replace and, in some situations, would require replacement of the lock to avoid the missing key posing a safety issue if found.

Embodiments of the present invention seek to alleviate one or more problems associated with the prior art.

SUMMARY

Accordingly, an aspect of the present invention provides an interlock system comprising: a first lock including a first lock memory configured to store one or more virtual keys; and a first key including a first key memory configured to store one or more virtual keys, wherein the first lock is configured to be actuated between a first condition and a second condition, when a first virtual key stored in the first key memory is transferred to the first lock memory, by engagement of the first key and first lock, and movement of the first key with respect to the first lock.

The first key may include a key shaft and a key head, and the first lock may define a key receiving aperture, wherein the key receiving aperture may be configured to receive at least a portion of the key shaft of the first key.

The first key may be positionable with respect to the first lock in: (i) a communication position, in which the first virtual key is transferrable from the first key memory to the first lock memory and actuation of the first lock between the first and second conditions is substantially prevented; and (ii) an actuation position, in which the first key is engaged with and moveable with respect to the first lock to actuate the first lock between the first and second conditions.

The first key may include an engagement release mechanism which may be configured to operate to control whether the first key is positionable in the actuation position.

The engagement release mechanism may be configured to operate to allow positioning of the first key in the actuation position when the first virtual key is transferred to the first lock memory.

The engagement release mechanism may include a pin located within pin receiving hole of first key.

The first key may include a collar which is configured to fit around at least part of a housing of the first lock.

The interlock system may further include a second lock, wherein the second lock: may include a second lock memory; and may be configured to be actuated between a first condition and a second condition, when a first virtual key stored in the first key memory is transferred to the second lock memory, by engagement of the first key and second lock, and movement of the first key with respect to the second lock.

The transfer of the first virtual key to the lock memory may be a copy operation.

The transfer of the first virtual key to the lock memory may be a move operation.

The interlock system may further include an actuator coupled to the first lock such that actuation of the first lock between the first and second conditions causes actuation of the actuator between first and second states.

Another aspect may provide an interlock key including: a key memory configured to store one or more virtual keys, a communication interface configured to transfer one or more virtual keys from the key memory to a first lock, and a key shaft configured to engage the first lock to actuate the first lock between a first and a second condition by movement of the interlock key with respect to the first lock.

The interlock key may further comprise an engagement release mechanism which is configured, in a first state, to prevent substantially the actuation of the first lock between the first and second conditions and, in a second state, to allow the actuation of the first lock between the first and second conditions.

The engagement release mechanism may be configured to adopt the second condition on detection by the interlock key that the interlock key is the correct key for the first lock.

Another aspect provides a user interface device communicatively coupled to an interlock key as above.

The user interface device may further comprise a display screen configured to provide a user with an indication of a sequence of one or more locks to be actuated by the interlock key.

Another aspect provides an interlock lock including: a lock memory configured to store one or more virtual keys, a communication interface configured to receive one or more virtual keys from a first key, and a key receiving aperture configured to receive at least a portion of the first key to actuate the interlock lock between a first and a second condition by movement of the first key with respect to the first lock.

The lock memory and communication interface may be passive such that they operate using electrical power generated by the interlock lock from a received electromagnetic signal.

Another aspect provides a safety system including an interlock system as above, and/or an interlock key as above, and/or a user interface device as above, and/or an interlock lock as above.

The safety system may further include one or more actuators configured to be controlled by the interlock lock or first lock.

BRIEF DESCRIPTION OF THE DRAWINGS

Embodiments of the invention are described, by way of example only, with reference to the accompanying drawings, in which.

DETAILED DESCRIPTION

Figure 1:
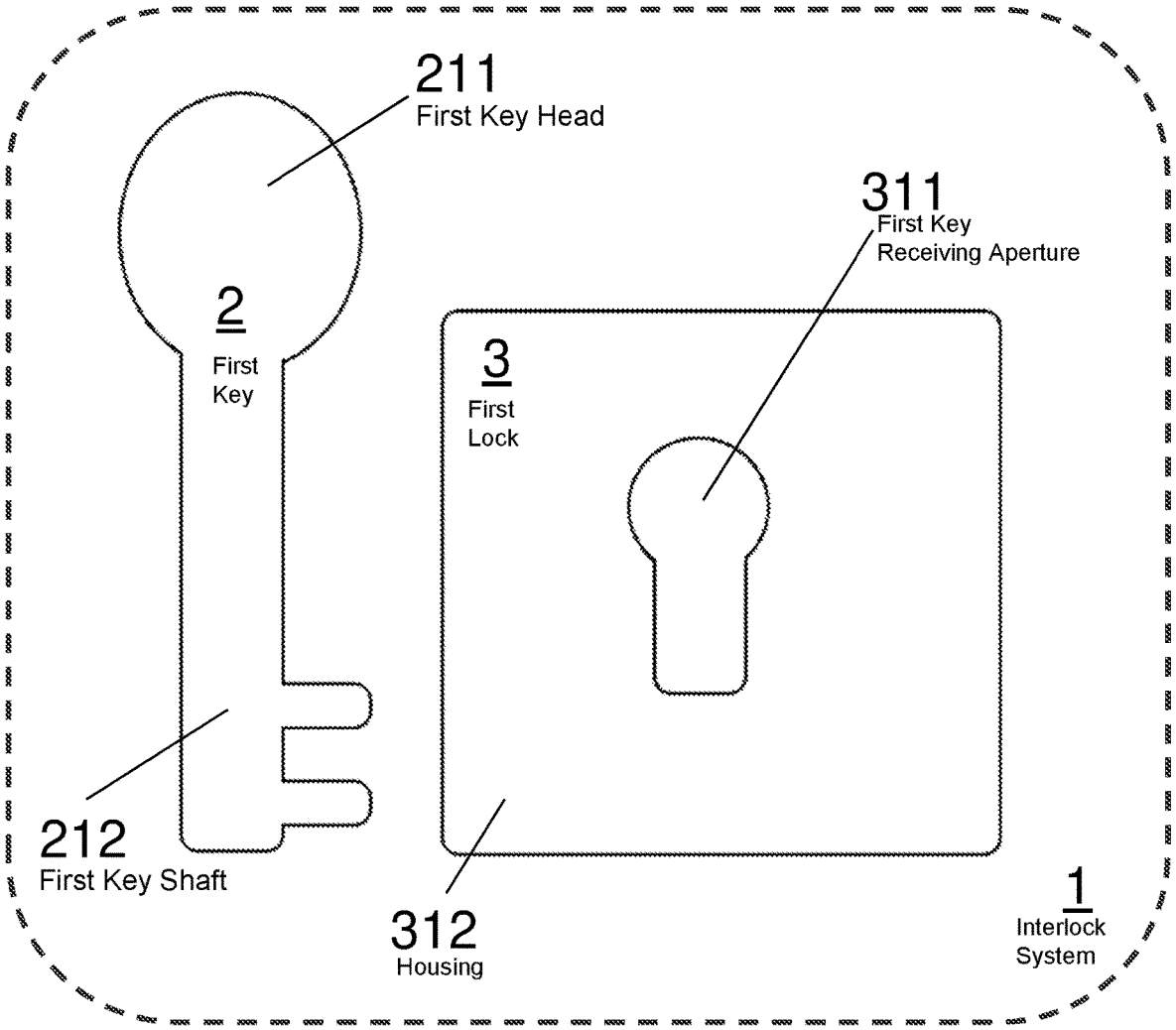
FIG. 1 shows a simplified representation of a lock and key according to some embodiments.

With reference to FIG. 1, embodiments of the present invention include an interlock system 1 which includes a first key 2 and a first lock 3. The first key 2 and first lock 3 are configured such that the first key 2 is engageable with the first lock 3 to actuate the first lock 3 between a first and a second condition.

The first key 2 and first lock 3 may be mechanically engageable such that a portion of the first key 2 is receivable by a portion of the first lock 3 to actuate the first lock 3 between the first and second conditions. Accordingly, the first key 2 may include a first key head 211 and a first key shaft 212. The first key shaft 212 (or a part thereof) may be the portion of the first key 2 which is receivable by a portion of the first lock 3, for example, and may be keyed to be so received. As such, the first lock 3 may define a first key receiving aperture 311 which is the portion of the first lock 3 which is the configured to receive the portion of the first key 2 (e.g. the first key shaft 212 (or part thereof)). The first key receiving aperture 311 (and more generally, the first lock 3) may be keyed to receive the first key 2.

In some embodiments, actuation of the first lock 3 between the first and second conditions includes movement of the first key 2 with respect to the first lock 3 when the first key 2 and first lock 3 are engaged. This may include, for example, receipt by the first lock 3 of the portion of the first key 2, rotation or linear movement of the first key 2 with respect to part of the first lock 3 to drive movement (e.g. linear or rotational) of a part of the first lock 3 to actuate the first lock 3 between the first and second conditions. The first key 2 may be removable from the first lock 3 with the first lock 3 in the first and second conditions and these may be different rotational positions of a part of the first lock 3 with respect to another part thereof. Accordingly, the first key 2 may be inserted into the first lock 3 with the first lock 3 in the first condition and removed from the first lock 3 with the first lock 3 in the second condition (and vice versa).

In some embodiments in which there are a plurality of keys of similar form to the first key 2 and a plurality of locks corresponding with the first lock 3, there is a need to provide a mechanism by which the correct keys are configured to actuate the correct locks.

This may be achieved mechanically in some embodiments by providing the first lock 3 to receive a key of the shape and configuration of the first key 2 and not to receive a key of a different shape or configuration.

In some embodiments of the present invention the correct key is identified at least partly through the use of one or more virtual keys. A virtual key is a code which may be transferred between the first key 2 and first lock 3, and may be a digital code which may be stored electronically (e.g. represented by a plurality of bits of information).

Figure 2:
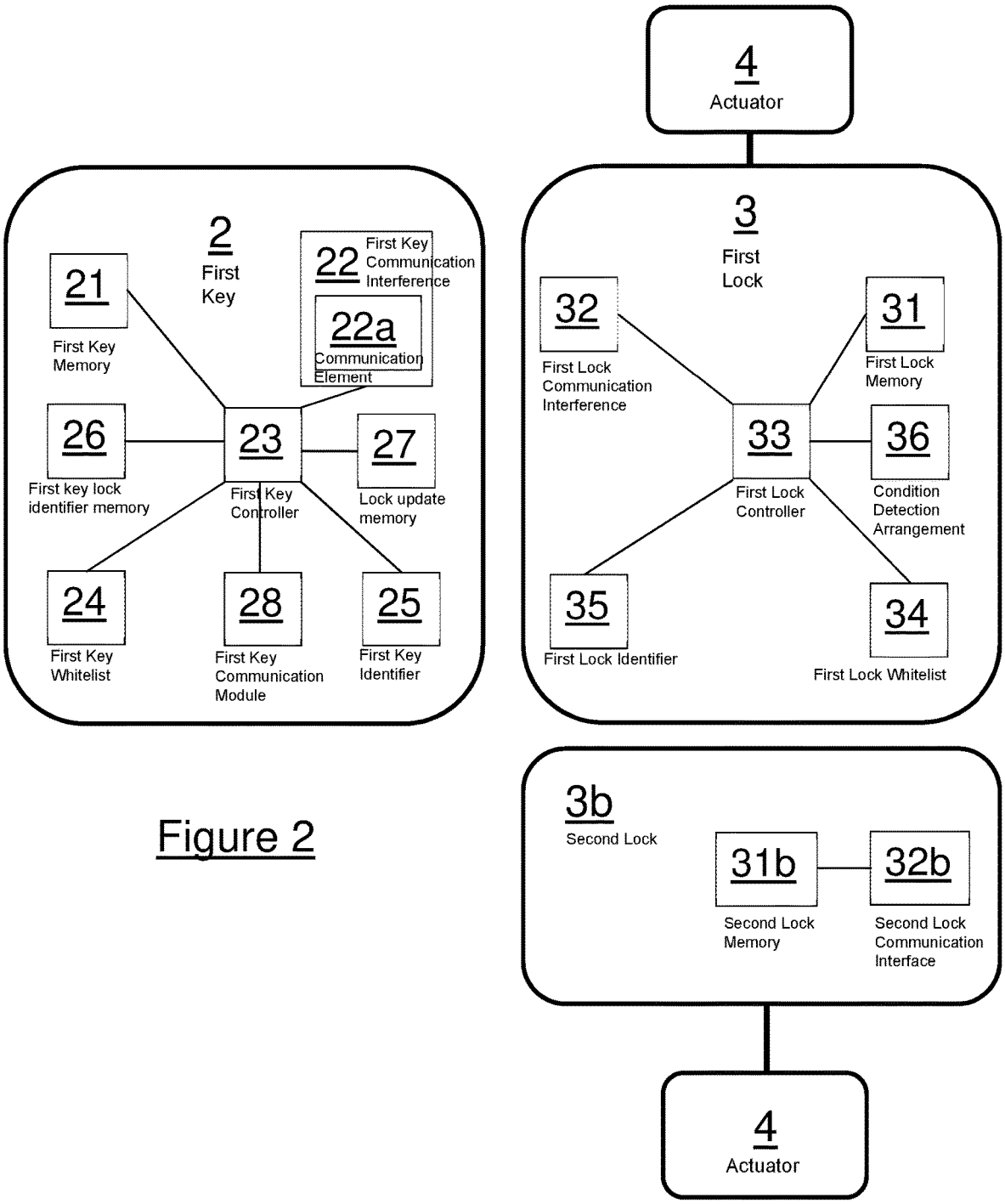
FIG. 2 show a schematic representation of an interlock system of some embodiments.

Accordingly, with reference to FIG. 2, the first key 2 may include a first key memory 21 which is a data storage memory configured to store a virtual key. Similarly, the first lock 3 may include a first lock memory 31 which is a data storage memory configured to store a virtual key.

The first key 2 and first lock 3 may be configured to exchange at least one virtual key therebetween, with the or each virtual key being stored in the first key memory 21 and/or first lock memory 31 as the case may be.

In some embodiments, this exchange of at least one virtual key includes the transfer of a virtual key which may be a move operation or a copy operation. A move operation and a copy operation differ in that a move operation causes movement of the virtual key such that the virtual key is only stored in one of the first key memory 21 and first lock memory 31 but not both, once the move operation is complete. However, in a copy operation, the virtual key is stored in both the first key memory 21 and first lock memory 31, once the copy operation is complete. The exchange of at least one virtual key may be a transfer of a first virtual key from the first key 2 to the first lock 3, the transfer of a first virtual key from the first lock 3 to the first key 2, or the transfer of a first virtual key from the first key 2 to the first lock 3, and the transfer of a second virtual key from the first lock 3 to the first key 2, or vice versa.

The first key 2 and the first lock 3, therefore, include respective communication interfaces—a first key communication interface 22 and a first lock communication interface 32. The communication interfaces 22,32 of the first key 2 and first lock 3 are configured to communicate with each other including the exchange of the virtual key, for example as described herein.

The first key communication interface 22 and the first lock communication interfaces 22,32 may use radio frequency communication signals to communicate. In some embodiments, the first key or lock communication interface 22,32 may be a passive interface such that the communication interface 22,32 generates electrical power for its operation through receipt of an electromagnetic (e.g. radio frequency) signal which may be generated and transmitted by the other of the communication interfaces 22,32. In some embodiments, the first key and/or lock communication interface 22,23 may be part of a radio frequency ID tag (and so the other of the communication interfaces 22,32 may be part of a radio frequency ID tag reader).

The first key 2 may include a first key whitelist 24 which is configured to store details regarding one or more virtual keys which the first key 2 is authorized to receive and/or store in the first key memory 21. Similarly, the first lock 3 may further include a first lock whitelist 34 which is configured to store the details regarding one or more virtual keys which the first lock 3 is authorized to receive and/or store in the first lock memory 31 and which may be required in order to actuate the first lock 3 between the first and second conditions. The first key whitelist 24 and first lock whitelist 34 may be provided on data storage memory which may be the same data storage memory which is also used for the first key memory 21 or the first lock memory 31 as the case may be.

The first key 2 may include a first key identifier 25 which may be stored on data storage memory which may also be used for the first key memory 21 and/or first key whitelist 24, for example. The first key identifier 25 includes a substantially unique identifier for the first key 2. In some embodiments the first key identifier 25 includes one or more type or usage codes—which may be codes which represent the type of first key 2, the manufacturer of the first key 2, the authorized user of the first key 2, the functionality of the first key 2, the intended use of the first key 2, and the like.

Similarly, the first lock 3 may include a first lock identifier 35 which may be stored on data storage memory which may also be used for the first lock memory 31 and/or first lock whitelist 34, for example. The first lock identifier 35 includes a substantially unique identifier for the first lock 3. In some embodiments the first lock identifier 35 includes one or more type or usage codes—which may be codes which represent the type of first lock 3, the manufacturer of the first lock 3, the authorized user of the first lock 3, the functionality of the first lock 3, the intended use of the first lock 3, and the like.

The first key 2 may include a first key lock identifier memory 26 which is configured to store the first lock identifier 35 and/or one or more other lock identifiers. The or each lock identifier may be stored in the first key lock identifier memory 26 when the first key 2 is currently actuating the lock to which the lock identifier relates and/or the lock identifier for each lock with which the first key 2 has exchanged one or more virtual keys may be stored—e.g. with each released virtual key being associated with a lock identifier in the first key lock identifier memory 26. The lock identifier may be removed from the first key lock identifier memory 26 when the first key 2 has completed actuation of the associated lock and/or when the virtual key released to the lock has been returned to the first key 2. Accordingly, the first key lock identifier memory 26 may record the identity of the locks with which it is currently or has previously interacted. The first key lock identifier memory 26 may be configured to store the current condition of the first lock 3 and any other locks with which it has interacted.

The first lock 3 may, therefore, include a condition detection arrangement 36 to determine its current condition—e.g. whether it is in the first or second condition. An indication of the current condition may be stored in the condition detection arrangement 36 (e.g. using a data storage memory which may also be used to store other data as described herein). This condition may be transmitted to the first key 2 (e.g. using the first key and first lock communication interfaces 22,32). In this and some other embodiments, the first key 2 may store the condition of the first lock in the first key lock identifier memory 26.

In some embodiments, the first key 2 is configured to determine whether the first lock 3 is in the first or second conditions—i.e. the condition detection arrangement 36 may form part of the first key 2 instead of the first lock 3 (and could form part of both in some embodiments). This may be done, for example by configuring the first key 2 and first lock 3 such that the first key 2 can determine its relative position (e.g. orientation) with respect to the first lock 3 on engagement of the first key 2 and first lock 3. This may, in turn, be achieved by the use of a plurality of identifiable indicators on the first lock 3 wherein a first such identifiable indicator can be detected with the first key 2 engaged and in a first relative position with respect to the first lock 3 (the position being indicative of the first condition) and wherein a second such identifiable indicator can be detected with the first key 2 engaged and in a second relative position with respect to the first lock 3 (the position being indicative of the second condition). The first key 2 may have an arrangement to detect the or each identifiable indicator. Accordingly, when the first identifiable indicator is detected, it is determined that the first lock 3 is in the first condition and when the second identifiable indicator is detected, it is determined that the first lock 3 is in the second condition.

The or each identifiable indicator may be a respective radio frequency ID tag, magnet, conductive track, protrusion, and/or a tag of a different material. Accordingly, the arrangement to detect the or each identifiable indicator may be a radio frequency ID tag reader, a Hall Effect sensor, part of a circuit (which may be completed by the conductive track), a mechanical switch (which may be actuated by the protrusion, e.g. a micro-switch), and/or an inductance or capacitance sensor (wherein the tag of different material alters the inductance or capacitance measured in the sensor).

The first lock 3 may include a first lock key identifier memory 35 which is configured to store the first key identifier 26 and/or one or more other key identifiers for keys with which it is currently or has previously interacted (which may, again, be stored in associated with virtual keys received from the associated key).

The first key 2 may include a lock update memory 27 which is configured to store one or more updates for transmission to the first lock 3. The one or more updates may include one or more software or firmware updates for one or more components of the first lock 3 and/or an updated first lock whitelist 34. The or each update may be transmitted to the first lock 3 using the communication interfaces 22,32 of the first lock 3 and first key 2.

The first key 2 may further include a first key controller 23 which is communicatively coupled with one or more of the other components of the first key 2—e.g. one or more of the first key memory 21, the first key communication interface 22, first key identifier 25, first key lock identifier memory 26, lock update memory 27, and the first key whitelist 2413 to control the operation and usage thereof.

Similarly, the first lock 3 may further include a first lock controller 33 which is communicatively coupled with one or more of the other components of the first lock 3—e.g. one or more of the first lock memory 31, the first lock communication interface 32, first lock identifier 35, condition detection arrangement 36, and the lock key whitelist 34—to control the operation and usage thereof.

Operation of some embodiments is depicted in FIGS. 2*a*-2*c*. In particular, each of FIGS. 3*a*-3*c* show the first key memory 21 and first key communication interface 22 along with the first lock memory 31 and first lock communication interface 32.

Figure 3A:
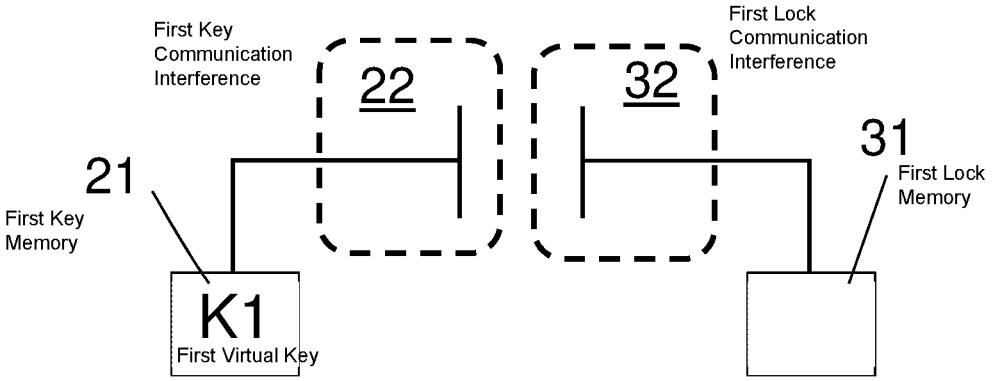
FIGS. 3*a*-3*c* show a virtual key transfer operation according to some embodiments.

In a first state—as shown in FIG. 3*a*—a first virtual key K1 is stored in the first key memory 21 and not stored in the first lock memory 31 (which is depicted as empty but may store a different virtual key). The first key 2 may be brought into communicative range of the first lock 3—such that the communication interfaces 22,32 can communicate with each other. This may involve receipt of the portion of the first key 2 by the portion of the first lock 3—see above. In this communicative position, the first lock 3 may communicate with the first key 2 to provide the first key 2 with an indication of the one or more virtual keys which are required in order to actuate the first lock 3 between the first and second conditions. This indication may be in the form of a part of the first lock whitelist 34, for example. In some embodiments, the first key 2 may determine if it has the required one or more virtual keys 2 and, if so, may transfer one or more such virtual keys 2 to the first lock 3.

Figure 3B:
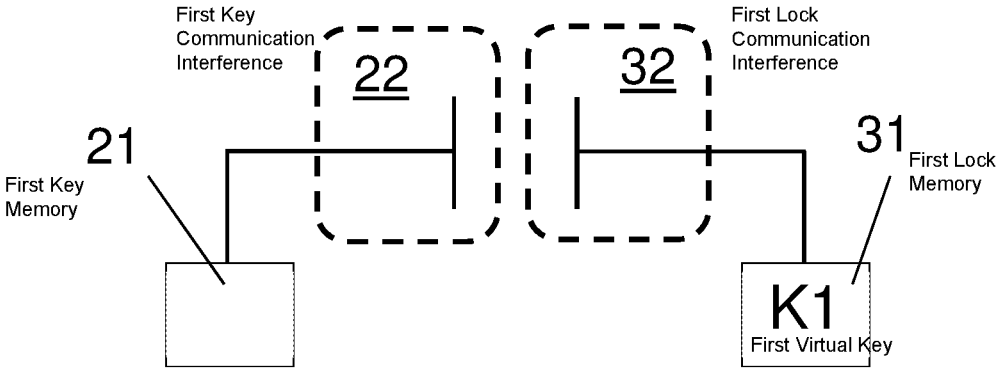
Figure 3C:
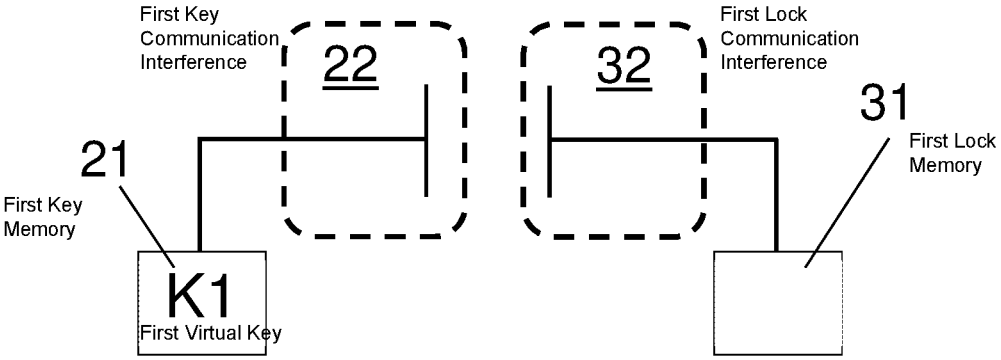

In a second state—as shown in FIG. 3*b*—the first virtual key K1 has been exchanged between the first key 2 and the first lock 3. In particular, the first virtual key K1 has been transferred (by a move operation in this instance although a copy operation would also have been possible in some embodiments) using the first key communication interface 22 and the first lock communication interface 32 to the first lock memory 31.

The exchange of the first virtual key K1 between the first key 2 and first lock 3 may be associated with actuation of the first lock 3 between the first condition and the second condition. Whether the first lock 3 is in the first or second condition may be determined in some embodiments by the condition detection arrangement 36. In some embodiments, the presence of a virtual key stored in the first lock memory 31 (or a particular virtual key) may allow actuation of the first lock 3 between the first and second conditions. The actual actuation of the first lock 3 may involve movement of the first key 2 (engaged with the first lock 3) with respect to the first lock 3—as described above.

Accordingly, the first lock 3 may be configured to hinder or substantially prevent actuation from the first condition to the second condition unless the first virtual key is stored in the first lock memory 31 and/or in some embodiments unless the first virtual key is determined as present on the first key 2. The first lock 3 may be configured to allow mechanical engagement of the first key 2 and first lock 3 to actuate the first lock 3 between the first and second condition (in some embodiments from the first to the second condition) when the first virtual key is stored in the first lock memory 31 and/or in some embodiments when the first virtual key is determined as present on the first virtual key 2.

In a third state—as shown in FIG. 3*c*—the first virtual key K1 has been exchanged between the first key 2 and the first lock 3. In particular, the first virtual key K1 has been transferred (by a move operation in this instance although a copy operation would also have been possible in some embodiments) using the first lock communication interface 32 and the first key communication interface 22 to the first key memory 21.

As will be appreciated, the third state is the same—in terms of the resulting storage of the first virtual key—as the first state; however, in the third state, the first virtual key may have been transferred to a different key (e.g. a second key) which is otherwise comparable to the first key 2 (i.e. with the same features and functionality).

The exchange of the first virtual key from the first lock 3 to the first key 2 (or some other key) may be triggered, for example, by actuation of the first lock 3 between the first and second condition (e.g. from the second condition back to the first condition). This may be achieved, as described above, by mechanical engagement of the first key 2 (or other key) and the first lock 3—and movement of the first key 2 with respect to the first lock 3.

In some embodiments, the first lock 3 is prohibited from actuation between the first and second conditions when the first virtual key is not stored in the first lock memory 31 and/or in some embodiments not determined to be present on the first key 2. When the first key memory 21 does not store the first virtual key, then that virtual key is not available to be exchanged with a different lock (otherwise having the same features and functionality as the first lock 3). Therefore, the first key 2 cannot be used to actuate another lock requiring the first virtual key. The first virtual key is effectively trapped in the first lock 3 whilst in the second state described above. This trapping may occur even through the first key 2 and first lock 3 are disengageable, in some embodiments, with the first lock 3 in either of the first or second conditions.

In some embodiments, the first key memory 21 may be configured to store a plurality of virtual keys which may each be configured to operate different locks.

The operation of such an embodiment is described, as an example, with reference to FIGS. 2 and 4*a*-4*h*.

Figure 4A:
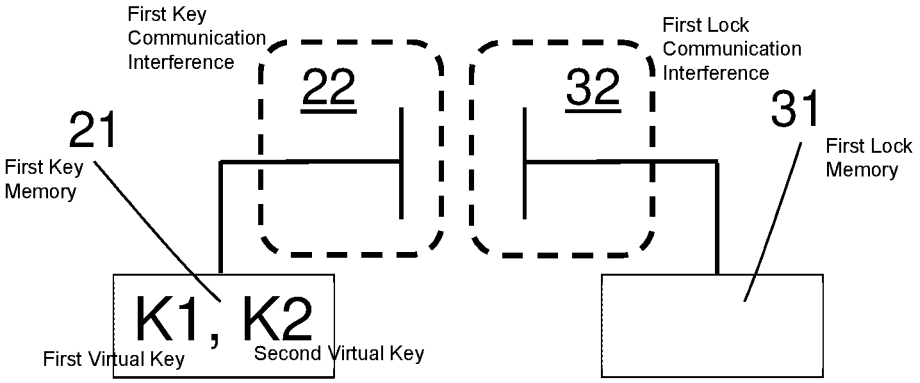
FIGS. 4*a*-4*h* show a virtual key transfer operation according to some embodiments.

As shown in FIG. 4*a*, the first key 2 includes the first key memory 21 storing the first virtual key K1 and a second virtual key K2. The first lock 3 is shown with the first lock memory 31 not storing either of the first or second virtual key K1,K2. This is the equivalent of the first state mentioned above.

Figure 4B:
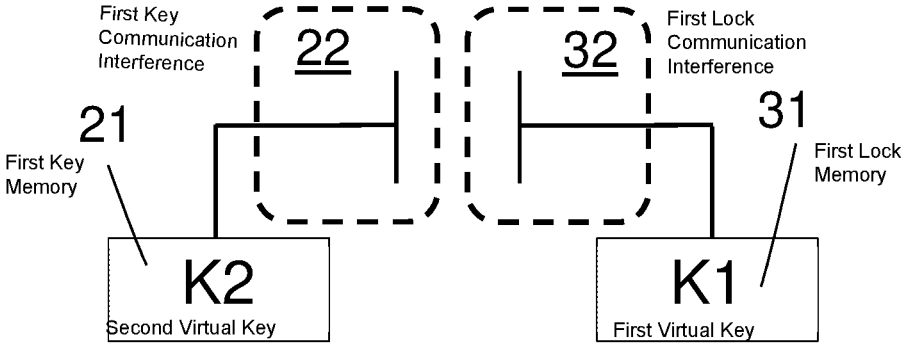

In FIG. 4*b*, the first virtual key K1 has been transferred from the first key memory 21 to the first lock memory 31 (via the communication interfaces 22,32 as described herein). The first lock 3 may then be actuatable between its first and second conditions—as discussed herein. This is equivalent to the second state mentioned above.

Figure 4C:
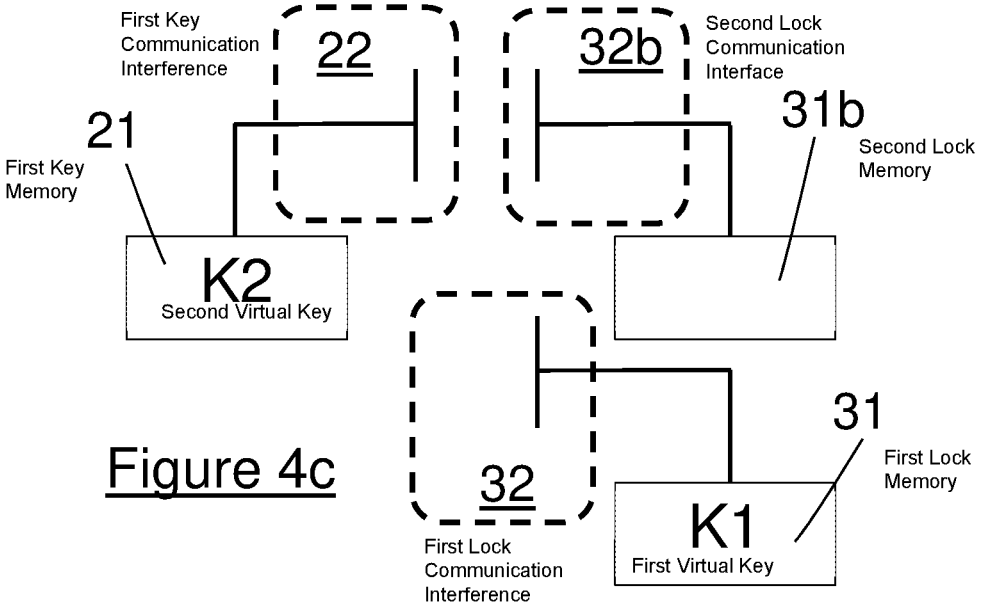

In FIG. 4*c*, the first key 2 is used to operate a second lock 3*b*—the second lock 3*b* has the same features and functionality as the first lock 3 as described herein. As can be seen, the second lock memory 31*b* does not store the first or second virtual key K1,K2 at this stage.

Figure 4D:
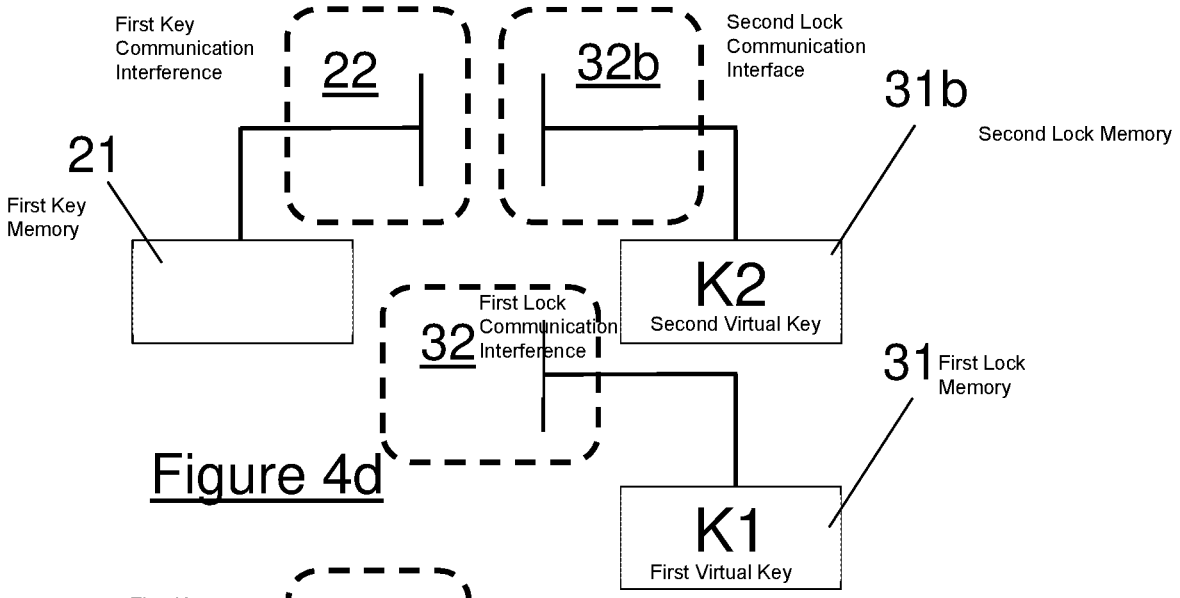

In FIG. 4*d*, the second virtual key K2 has been transferred from the first key memory 21 to the second lock memory 31*b* using the first key communication interface 22 and the second lock communication interface 32*b*. The second lock memory 31*b*, therefore, stores the second virtual key K2. The second lock 3*b* may then be actuatable between its first and second conditions—as discussed herein.

Accordingly, the same first key 2 may be used to actuate a plurality of locks (e.g. the first and second locks 3,3*b*).

Figure 4E:
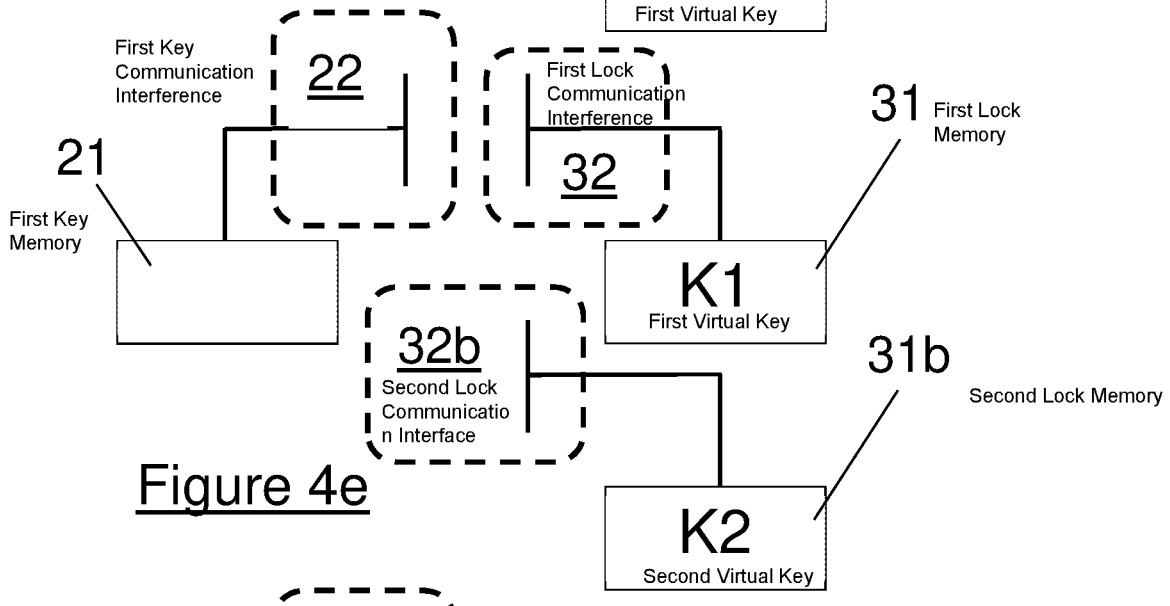

In FIG. 4*e*, the first key 2 (now not storing the first or second virtual key K1,K2) is used to retrieve the first virtual key K1. Accordingly, the first key 2 is positioned to communicate with the first lock 3. The first virtual key K1 is transferred (again using the communication interfaces 22,32) from the first lock memory 31 to the first key memory 21, this may be permitted on actuation of the first lock 3 between the first and second conditions.

Figure 4F:
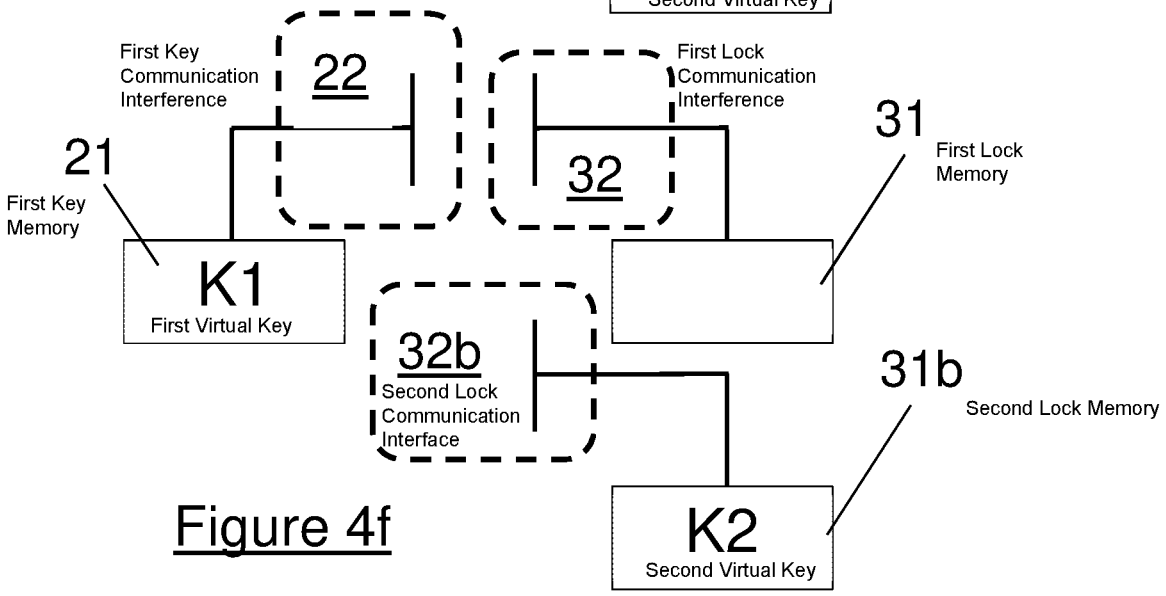

As can be seen in FIG. 4*f*, the first virtual key K1 may be transferred so that it is stored in the first key memory 21 and is no longer stored in the first lock memory 31.

Figure 4G:
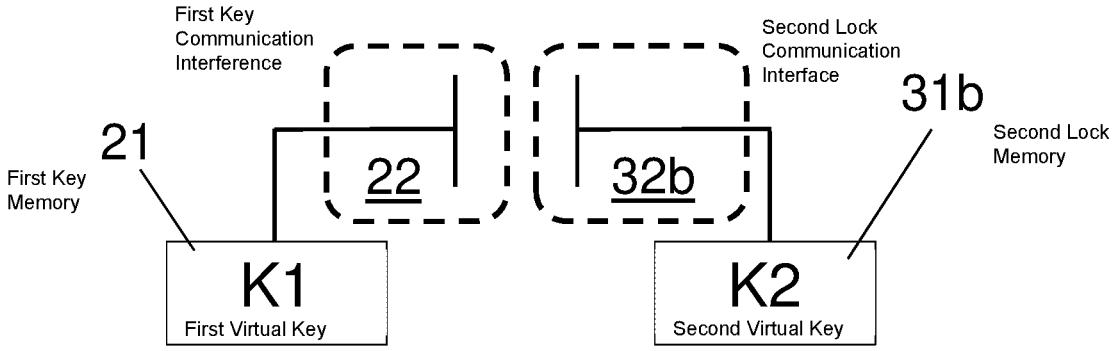
Figure 4H:
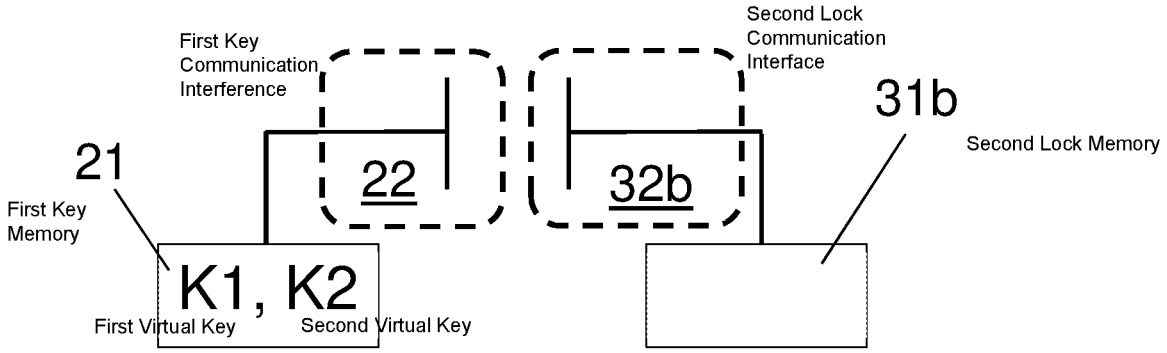
Figure 5:
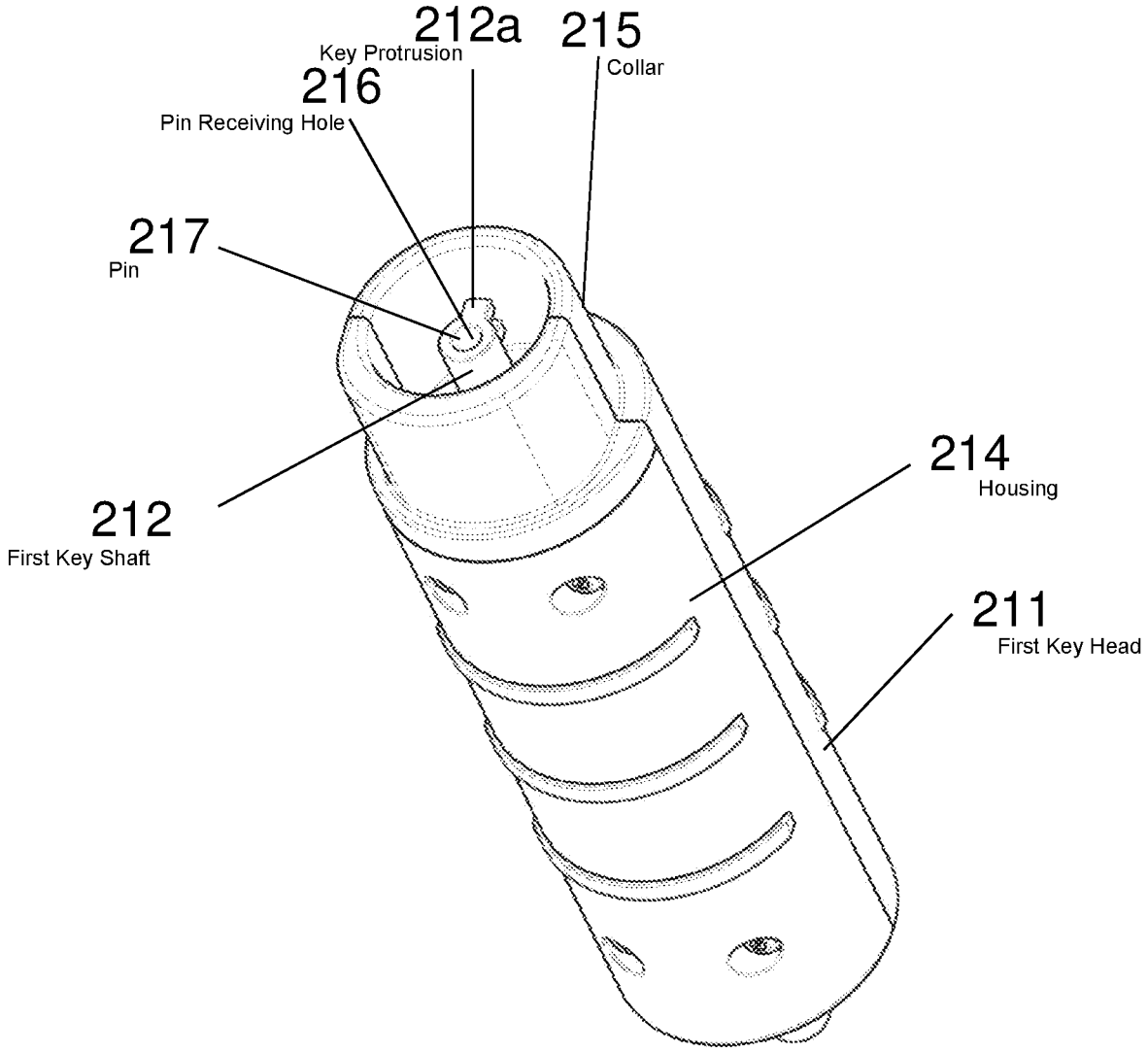
FIGS. 5 and 6 show external views of a key of some embodiments.
Figure 6:
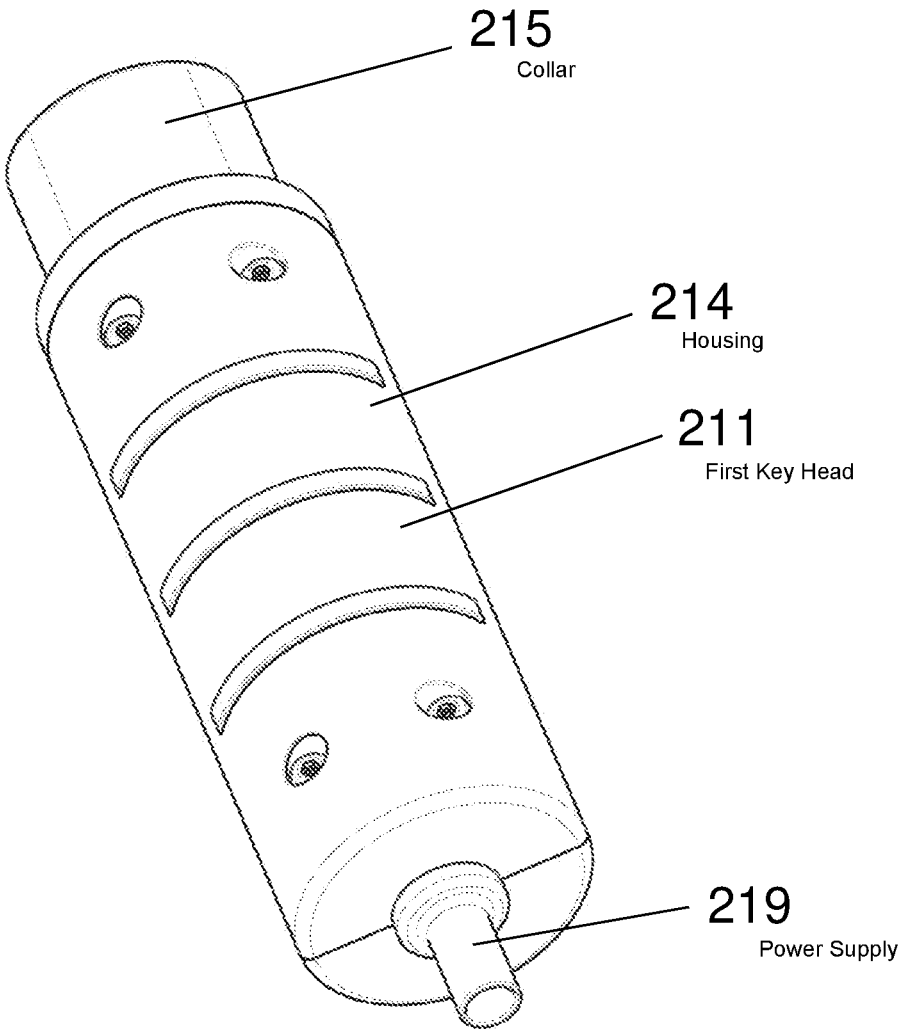
Figure 7:
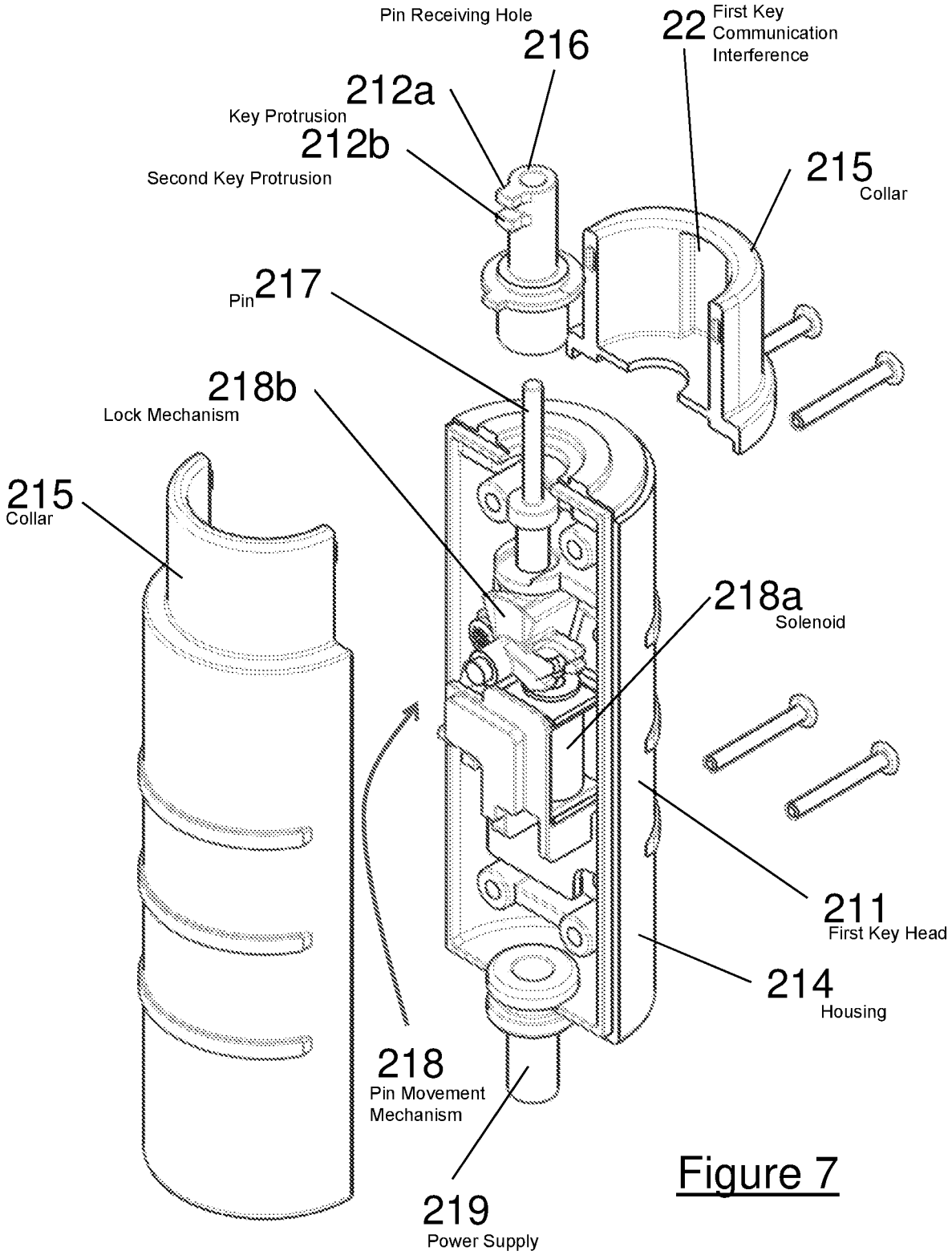
FIG. 7 shows an exploded view of a key of some embodiments.
Figure 8:
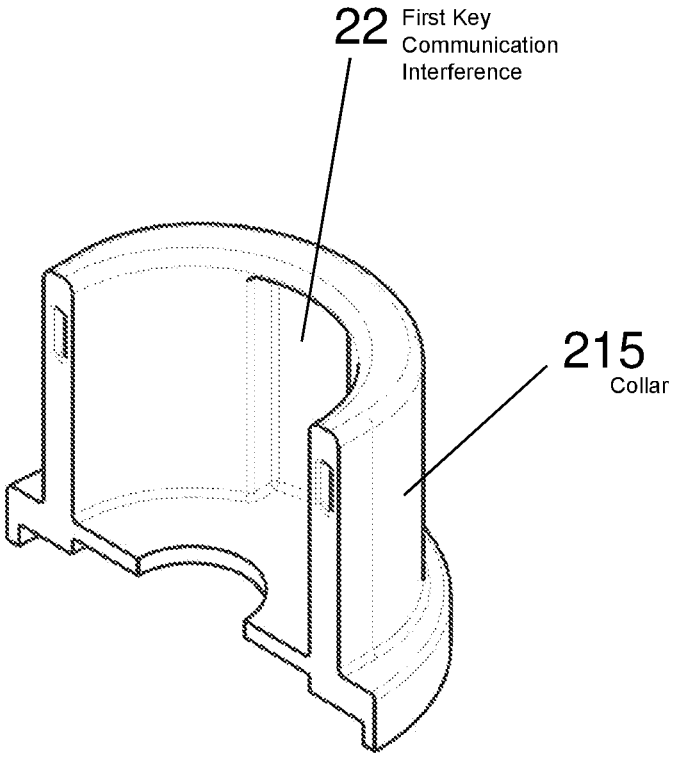
FIG. 8 shows a collar of a key of some embodiments.
Figure 9:
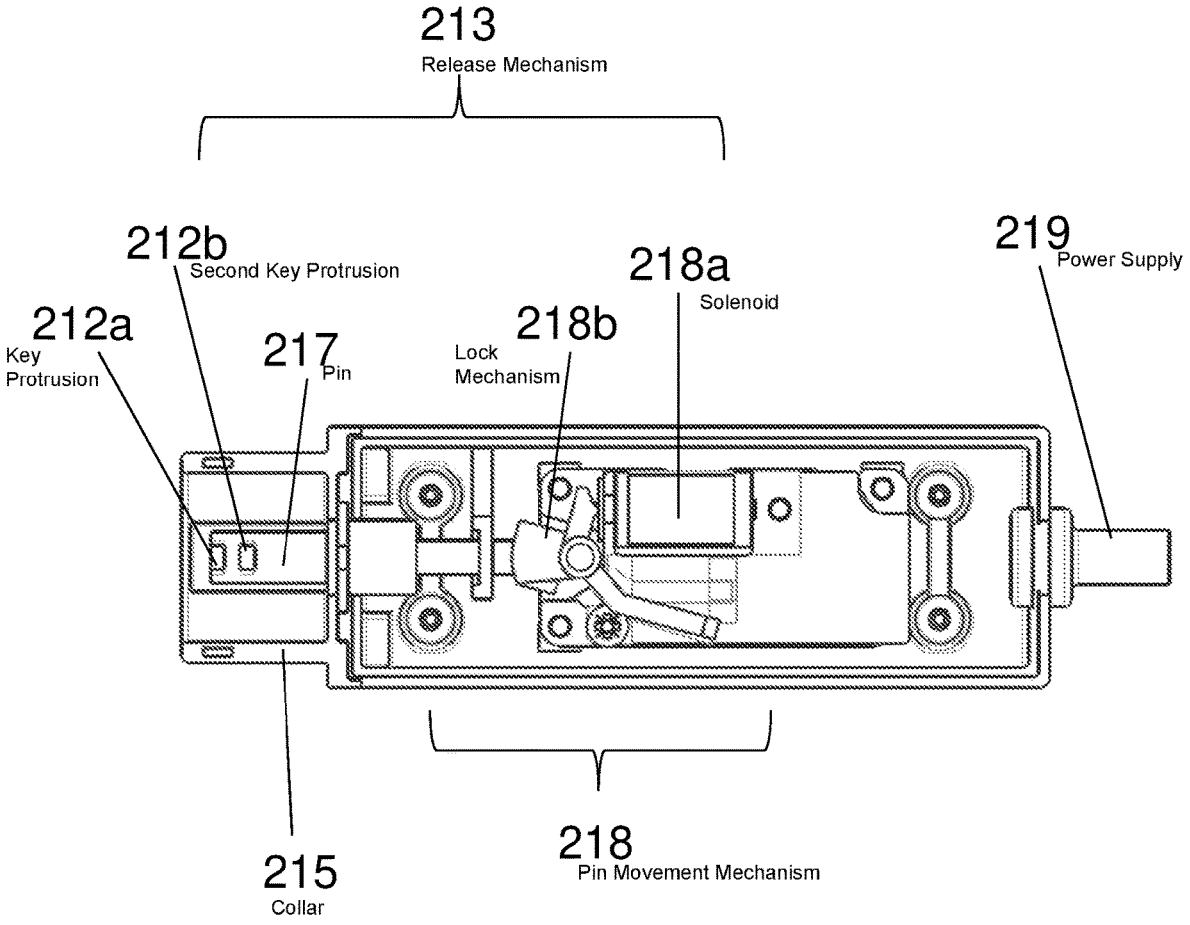
FIG. 9 shows a cross-sectional view through a key of some embodiments.
Figure 10:
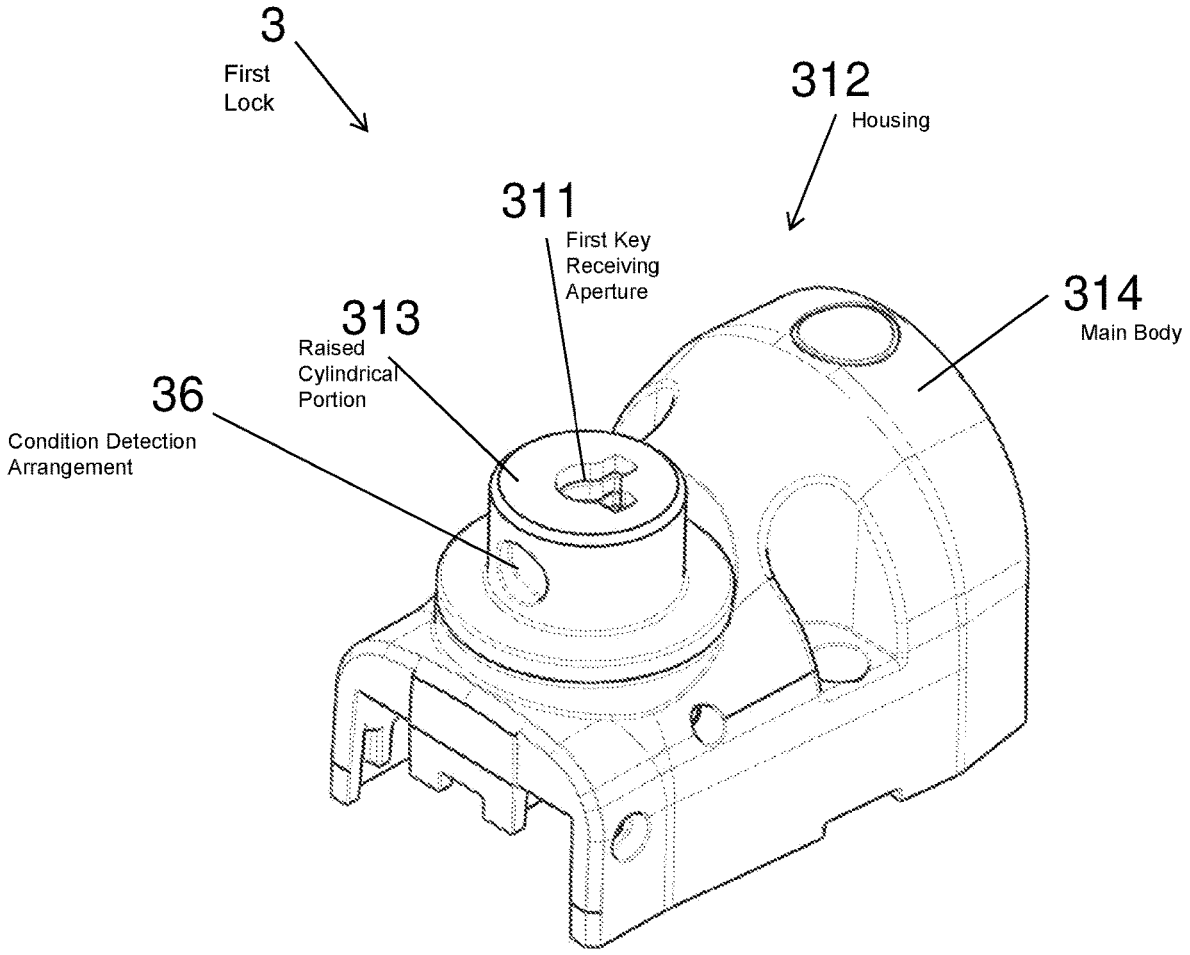
FIGS. 10 and 11 show external views of a lock of some embodiments.
Figure 11:
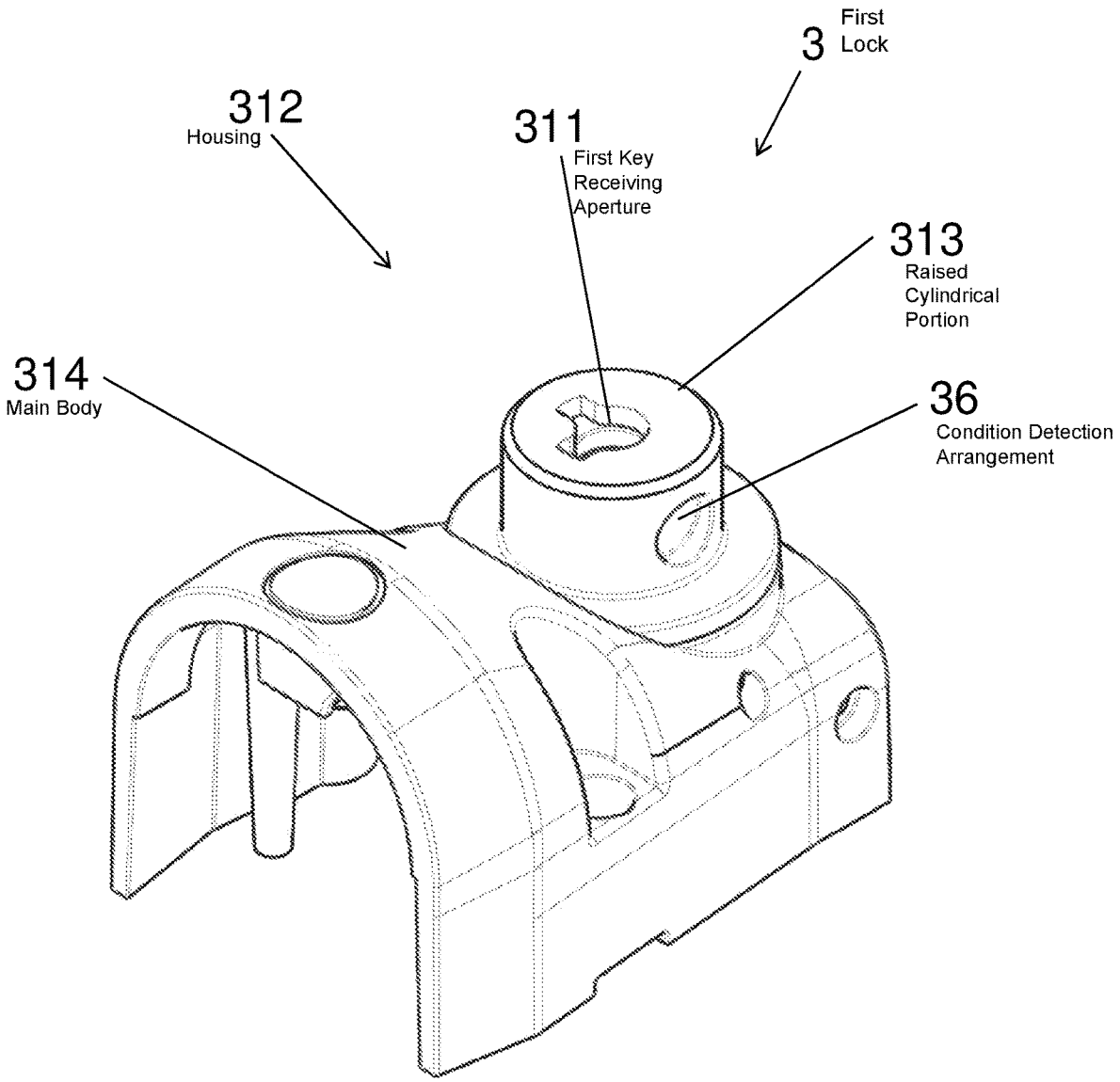
Figure 12:
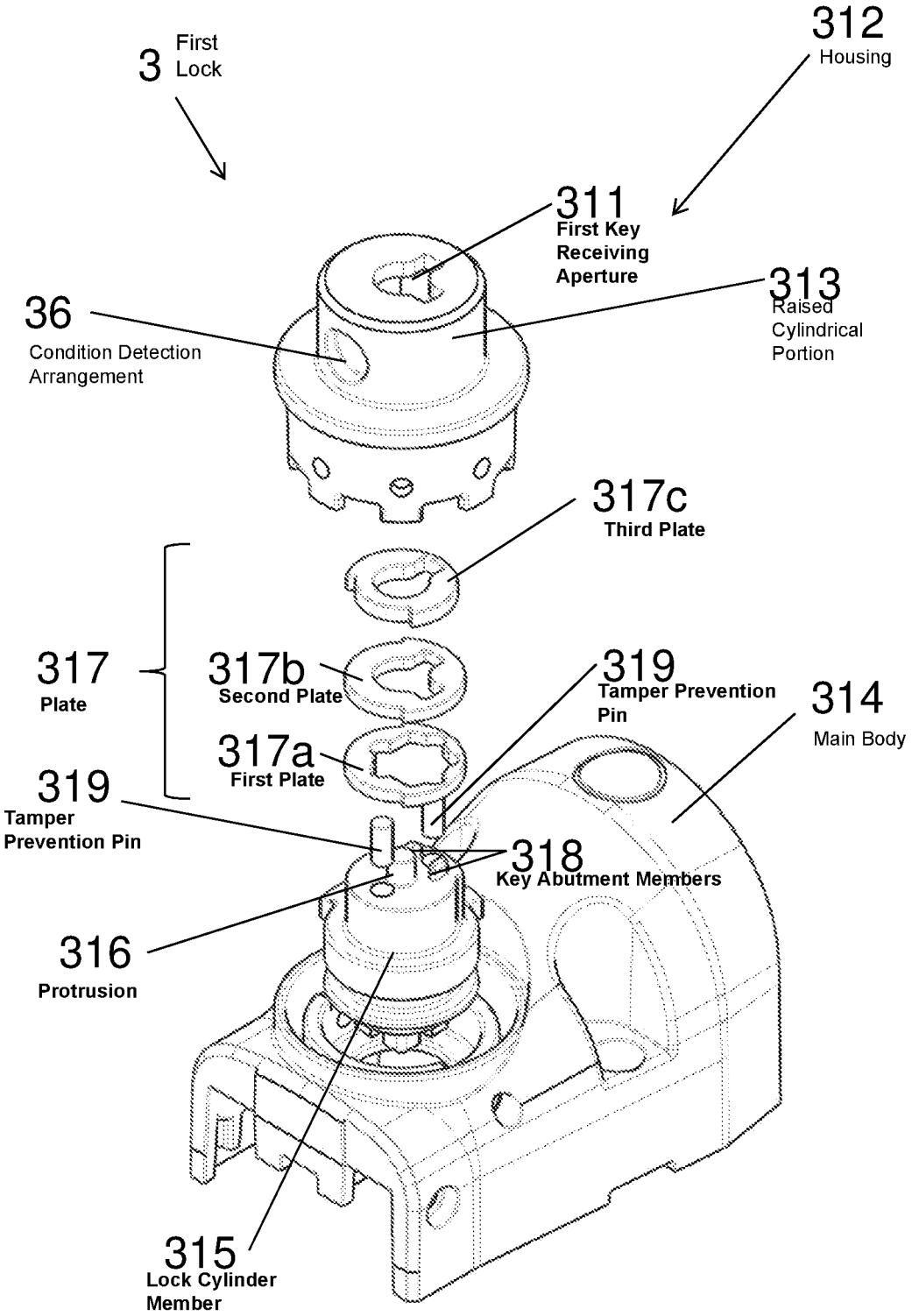
FIG. 12 shows an exploded view of a lock of some embodiments.
Figure 13:
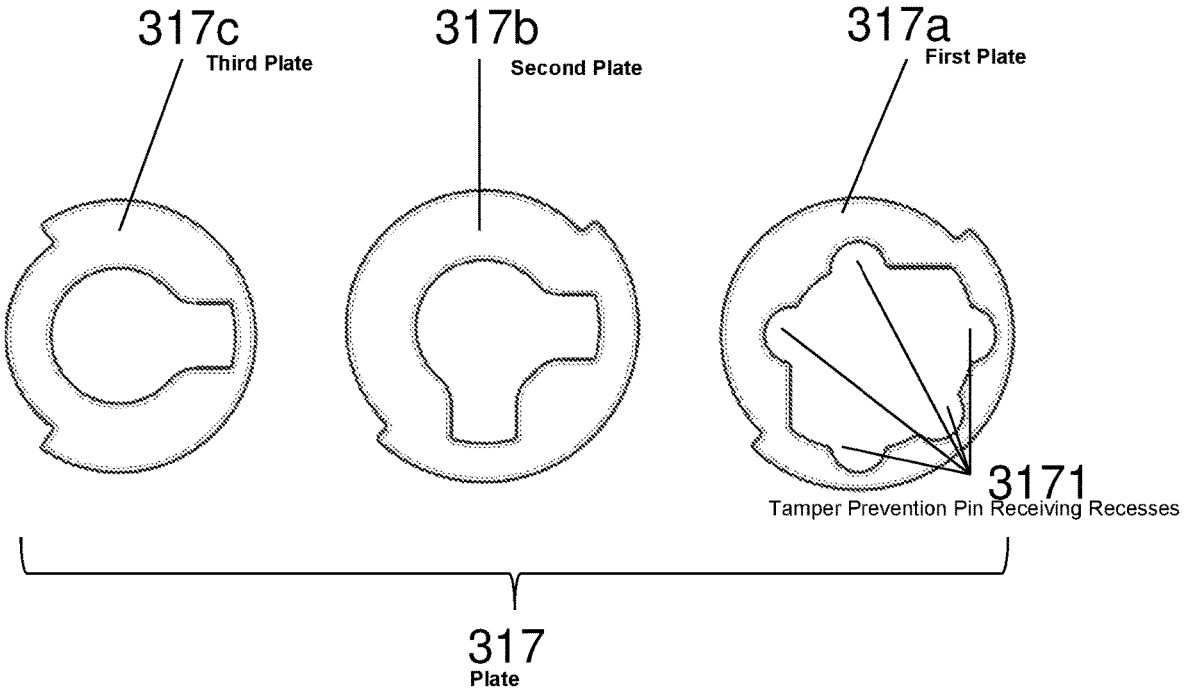
FIG. 13 show one or more plates for use in a lock of some embodiments.
Figure 14:
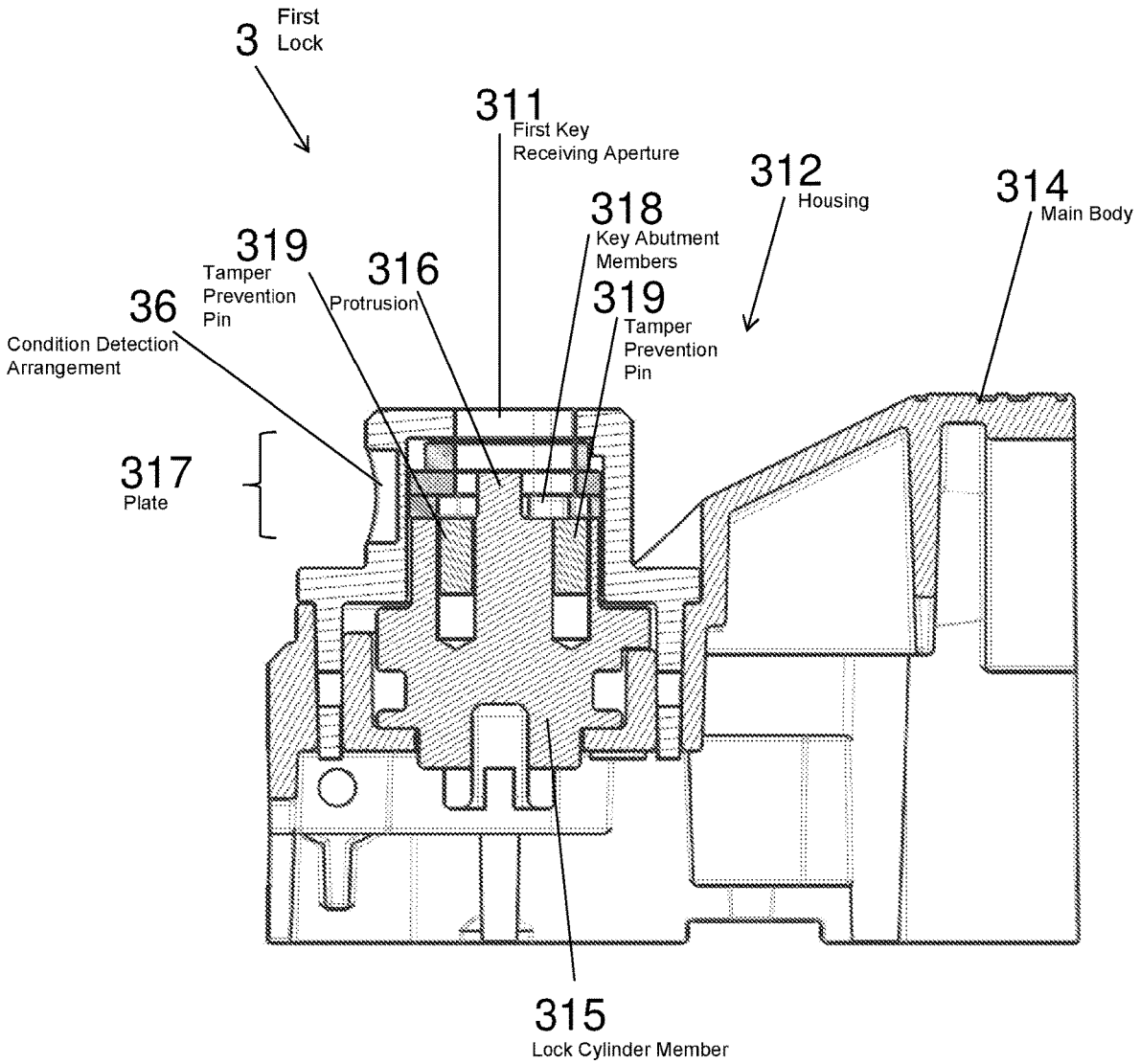
FIG. 14 shoes a cross-section through a lock of some embodiments.

As can be seen in FIGS. 4*g* and 4*h*, the first key 2 may be positioned to communicate with the second lock 3*b* to retrieve the second virtual key K2—which may be transferred (over the communication interfaces 22,32*b*) from the second lock memory 31*b* to the first key memory 21 on actuation of the second lock 3*b* between the first and second conditions.

In some embodiments, the first key 2 and first lock 3 (and other keys and locks sharing their features and functionality) may be configured only to accept a virtual key K1,K2 if that virtual key is listed in their respective first key whitelist and first lock whitelist 24,34.

In some embodiments, the first key whitelist and first lock whitelist 24,34 may include sequence or logic information which determines which virtual key the first key 2 and first lock 3, as the case may be, will accept next.

If a virtual key held by the first key 2 not accepted by the first lock 3, then actuation of the first lock 3 between the first and second conditions may be prohibited by that first key 2. Similarly, if a virtual key held by the first lock 3 is not accepted by the first key 2, then actuation of the first lock 3 by the first key 2 between the first and second conditions may be prohibited by that first key 2.

In some embodiments, different virtual keys are required in order to actuate the first lock 3 from the first condition to the second condition compared to actuation of the first lock 3 from the second condition to the first condition. The first key 2 may store both one or more of these virtual keys.

In some embodiments, there may be more than a first and a second condition of the first lock 3—the first lock 3 may have one or more further conditions and, accordingly, in some embodiments one or more virtual keys are required to transition between any two of the conditions as between the first and second condition as described herein. The above described features in relation to the first and second conditions may be replicated for any further conditions (e.g. such that the third or additional condition can be detected).

The use of virtual keys and respective whitelists 24,34 allows embodiments of the invention to impose sequences of operation of locks. Indeed, in some embodiments, the first lock whitelist 34, for example, may indicate that multiple virtual keys are required in order actuate the first lock 3 between the first and second conditions. This may require the collection, by the first key 2, of those virtual keys from different locations (e.g. from other locks).

The interlock system 1 may be a trapped key interlock system and, as will be understood, a traditional trapped key interlock uses a plurality of keys and locks to enforce a desired sequence of operations—e.g. for ensuring safe access and/or operation of equipment protected by the traditional trapped key interlock system. In embodiments, virtual keys are used to ensure that a particular key is authorized to actuate a particular lock and sequences of operation of locks may be imposed. Therefore, embodiments of the present invention may replicate some aspects of the operation of a trapped key system using one or more virtual keys.

With each exchange of a virtual key between the first lock 3 and first key 2, one or more of the first key whitelist 24, first lock whitelist 34, first key lock identifier memory 26, and first lock key identifier memory 35 may be updated to reflect the exchange.

With reference to FIGS. 5 to 14, the first key 2 and/or the first lock 3 may be configured to inhibit or substantially prevent full engagement therebetween unless the first key 2 is authorized for use with the first lock 3. This authorization may be determined by one or more of:

the first key 2 determining that it is authorized to interact with the first lock 3 based on the first lock identifier 35, the first lock 3 determining that it is authorized to interact with the first key 2 based on the first key identifier 25, the first key 2 determining that the first lock 3 has stored in the first lock memory 31 a virtual key which the first key 2 can accept, the first key 2 determining that it has stored in the first key memory 21 a virtual key which the first lock 3 can accept (e.g. based on an indication provided by the first lock 3), the first lock 3 determining that the first lock 3 has stored in the first lock memory 31 a virtual key which the first key 2 can accept, and the first lock 3 determining that there is stored in the first key memory 21 a virtual key which the first lock 3 can accept.

The first key 2 and first lock 3 may, therefore, be partially engageable in a first position with respect to each other and only released into full engagement if it is determined that the first key 2 is authorized for use with the first lock 3. The partially engaged position will be referred to herein a communication position and the fully engaged position will be referred to herein as an actuation position.

This may be achieved using an engagement release mechanism of either or both of the first key 2 and the first lock 3. In the depicted embodiments, the engagement release mechanism 213 is provided as part of the first key 2.

This communication position is sufficient (e.g. allows sufficiently close proximity) for the first key communication interface 22 to communicate with the first lock communication interface 32. As such, in this partially engaged position the first key 2 can determine one or more of the first lock identifier 35, the one or more virtual keys stored in the first lock memory 31, the condition of the lock 3, one or more virtual keys required to actuate the first lock 3, and the like. Similarly, the first lock 3 may be configured to determine one or more of the first key identifier 25, the one or more virtual keys stored in the first key memory 21, and the like.

In some embodiments, an indication of the or each virtual key which the first lock 3 requires for its actuation may be communicated, via the first lock communication interface 32 and first key communication interface 22, to the first key 2. The first key 2 may determine whether it has stored thereon any one or more virtual keys which are required to actuate the first lock 3 (this determining may be made by the first key controller 23). If so, then one or more of these keys may be transferred to the first lock 3 and/or may be determined to be the authorized key.

If the communication results in the first key 2 (or first lock 3 in some embodiments) determining that the first key 2 is authorized to actuate the first lock 3, then the engagement release mechanism 213 is operated to allow the first key 2 to engage fully with the first lock 3 and, therefore, to actuate the first lock 3 between the first and second conditions.

In the depicted embodiment of FIGS. 5-9, the engagement release mechanism is provided as part of the first key 2.

The first key 2 may comprise a housing 214. In some embodiments, and as depicted, the housing 214 form the first key head 211 and serves as a collar for the first key shaft 212. Accordingly, in this and some other embodiments, the first key 2 housing 214 includes a collar 215 which at least partially surrounds the first key shaft 212.

The first key shaft 212 may be keyed to be at least partially received by the first key receiving aperture 311 of the first lock 3. The collar 215 of the first key 2 is configured to fit around at least a portion of a housing 312 of the first lock 3 in the region of the first key receiving aperture 311. In some embodiments, the housing 312 of the first lock 3 includes a raised cylindrical portion 313 through which is defined the first key receiving aperture 311. The collar 215 of the first key 2 may be configured to fit around the raised cylindrical portion 313 and this may be a close fit. Accordingly, the collar 215 may have a generally circular cross-section. A central longitudinal axis of the first key shaft 212 may be generally aligned with a central longitudinal axis of the collar 215.

The first key shaft 212 may define a pin receiving hole 216 which may be located along the central longitudinal axis of the first key shaft 212. The pin receiving hole 216 may be configured to receive a pin 217 which may extend from within the first key 2 towards the end of the first key shaft 212. In some embodiments, the pin 217 does not extend beyond an end of the first key shaft 212. The pin 217 may, therefore, be positioned within the first key shaft 212.

The pin 217 is coupled to a pin movement mechanism 218. The pin movement mechanism 218 is configured to move the pin 217 between a retracted and an extended position with respect to the first key shaft 212. In the extended position, a distal end of the pin 217 is closer to the end of the first key shaft 212 than in the retracted position. Accordingly, in the retracted position, a portion (or greater portion) of the pin receiving hole 216 is accessible from outside of the first key 2.

The pin movement mechanism 218 may include a resilient biasing arrangement which is configured to bias the pin 217 into the extended position. The pin movement mechanism 218 may include a solenoid 218*a* which is configured to drive a lock mechanism 218*b* to lock the pin 217 in the extended position.

The engagement release mechanism 213 may, therefore, comprise one or both of the pin 217 and the pin movement mechanism 218.

The first key 2 may further include a power supply 219 which is configured to power one or more components of the first key 2. The power supply 219 may be in the form of a battery or may be a connector for coupling to an external source of electrical power.

The first key 2 may include circuitry (e.g. on a printed circuit board) which may provide, for example, the first key memory 21, the first key communication interface 22, the first key controller 23, the first key whitelist 24, the first key identifier memory 25, the first key lock identifier memory 26, and/or the lock update memory 27.

In some embodiments, the first key communication interface 22 includes a communication element 22*a* which is located in the region of the collar 215 and/or the first key shaft 212. In some embodiments, the communication element 22*a* is located within the collar 215.

The communication element 22*a* may be an antenna and may be in the form of a coil. In some embodiments, the communication element 22*a* comprises one or more electrical contacts. The communication element 22*a* may be provided within the collar 215 in the sense that it is within a volume at least partially defined by the collar 215 (which may be the same volume in which the first key shaft 212 is located) or may be embedded within the material of the collar 215. In some embodiments, the collar 215 includes at least one internal slot in which the communication element 22*a* is substantially located.

In some embodiments, the first key communication interface 22 may include more than one such communication element 22*a*—which may be spaced apart around the collar 215, for example.

As mentioned above, the first lock 3 may include a raised cylindrical portion 313 of the housing 312, thereof, about which the collar 215 of the first key 2 is configured to at least partially fit.

The housing 312 of the first lock 3 may include a plurality of housing parts—of which the raised cylindrical portion 313 is one. The raised cylindrical portion 313 may be provided as a portion which is removable from a main body 314 of the housing 312—removal may, however, require one or more specialist tools.

The main body 314 of the housing 312 and the raised cylindrical portion 313 may define therebetween a lock cylinder cavity in which a lock cylinder member 315 is provided. The lock cylinder member 315 may be rotatable within the housing 312 (with respect thereto).

The lock cylinder member 315 may be actuatable (e.g. rotatable) with respect to the housing 312 between at least two positions—each position representing one of the two conditions of the first lock 3. Therefore, in the first condition, the lock cylinder member 315 may be in a first position with respect to the housing 312 and, in the second condition, the lock cylinder member 315 may be in a second position with respect to the housing 312—the first and second positions being different.

The lock cylinder member 315 may include one more features configured to engage one or more features of one or more actuators 4 which are controlled by operation of the first lock 3 (e.g. such that the one or more actuators 4 are in a first operating state when the first lock 3 is in the first condition and in a second operating state when the first lock 3 is in the second condition). The operating state may be, for example, operating or stopped or disconnected or connected or the like.

Accordingly, irrespective of the configuration of the first lock 3, the first lock 3 may be configured to operate one or more actuators 4 between operating states thereof.

The lock cylinder member 315 may include a protrusion 316 which is positioned with respect to the first key receiving aperture 311 such that, when the first key 2 is in the communication position, the end of the pin 217 abuts the protrusion 316. Accordingly, the protrusion 316 may extend into a portion of the lock cylinder cavity which is configured to receive at least part of the first key 2 (e.g. at least the portion of the first key shaft 212. The protrusion 316 may be such that, with the pin 217 in the extended position, the first key 2 is inhibited or substantially prevented from actuating the first lock 3 but with the pin 217 in the retracted position, the first key 2 is substantially free to actuate the first lock 3.

The lock cylinder member 315 may include one or more key abutment members 318 which are configured to abut a portion of the first key 2 (e.g. a part of the first key shaft 212) when received by the first lock 3 with the first key 2 in the actuation position with respect to the first lock 3. The or each key abutment member 318 may be configured to transfer movement (e.g. rotational movement) of the first key 2 (e.g. the first key shaft 212) to the lock cylinder member 315.

Accordingly, in some embodiments, the first key shaft 212 includes at least one key protrusion 212*a,b* which extend away from the longitudinal axis of the first key shaft 212 and which may extend generally perpendicular to that axis.

A first 212*a* of the at least one key protrusion may be configured to be received between two key abutment members 318—such that rotation of the first key shaft 212 in either direction will cause the first key protrusion 212*a* to abut a respective one of the key abutment members 318 to drive rotation of the lock cylinder member 315 in a respective direction.

The lock cylinder member 315 be further associated with one or more plates 317 of the first lock 3. The or each plate 317 provides a different functionality to the first lock 3. The or each plate 317 may be located between a face of the lock cylinder member 315 and an internal face of the raised cylindrical portion 313 of the housing 312 of the first lock 3.

The or each plate 317 may be configured for rotation with the lock cylinder member 315. In some embodiments, the or each plate 317 is restricted from rotation with the lock cylinder member 315 and this may mean that the or each plate 317 does not rotate with the lock cylinder member 315 or that rotation with the lock cylinder member 315 is restricted to just a portion of the total rotational freedom of the lock cylinder member 315 (with respect to the housing 312).

The or each plate 317 may include one or more warding plates and/or coding discs. In some embodiments, one or more linear or radial pin tumblers may be provided for a similar functionality.

A first plate 317*a* is, in some embodiments, located adjacent the lock cylinder member 315. The first plate 317*a* defines one or more tamper prevention pin receiving recesses 3171. The or each tamper prevention pin receiving recesses 3171 is configured to receive at least part of at least one tamper prevention pin 319. The or each tamper prevention pin 319 configured to hinder or substantially prevent rotation of the lock cylinder member 315 by a key which is not the first key 2 (or by some other object). Accordingly, the or each tamper prevention pin 319 may be housed at least partially within the lock cylinder member 315 and biased towards a position in which they extend out thereof. A resilient biasing arrangement may be provided as part of the lock cylinder member 315 to achieve this (the resilient biasing arrangement may include at least one spring, such as a helical spring). With the or each tamper prevention pin 319 in its extended position, the or each tamper prevention pin 319 may be at least partially received by a respective one of the tamper prevention pin receiving recesses 3171 of the first plate 317*a*. This engagement and abutment of the first plate 317*a* with the housing 312 (e.g. at an outer edge of the first plate 317*a*) may hinder or substantially prevent rotation of the lock cylinder member 315 with respect to the housing 312. When the first key 2 is in the actuation position, a part of the first key 2 (e.g. the first key protrusion 212*a*) may engage the or each tamper prevention pin 319 and move the or each tamper prevention pin 319 against the biasing force into a respective retracted position—in which the or each tamper prevention pin 319 is not received by a respective one of the tamper prevention pin receiving recesses 3171. This, in turn, allows rotation of the lock cylinder member 315 with respect to the housing 312.

In some embodiments, there are at least two such tamper prevention pins 319. The first plate 317*a* may include a plurality of possible rotational positions with respect to the lock cylinder member 315 in which the tamper prevention pins 319 may be received (at least partially) by the tamper prevention pin receiving recesses 3171. This is intended, to hinder or substantially prevent a foreign object or incorrect key from operating the first lock 3.

The first key 2 may be configured to move the or each tamper prevention pin 319 into the retracted position only when the pin 217 thereof is in the retracted position. With the pin 217 of the first key 2 in the extended position, the first key 2 may be held apart from the tamper prevention pin or pins 319 (or held such that the first key 2 is generally prevented from moving the or each tamper prevention pin 319 into the retracted position). Accordingly, if the pin 217 of the first key 2 is in the extended position, the first key 2 is in the communication position with respect to the first lock 3 but with the pin 217 in the retracted position, the first key 2 may move into the actuation position—in which the first lock 3 can be actuated by the first key 2.

The one or more plates 317 may include a second plate 317*b*. This second plate 317*b* may be positioned between the first plate 317*a* and the internal face of the raised cylindrical portion 313 of the housing 312 of the first lock 3. The second plate 317*b* may, for example, define a plurality of different possible first key 2 orientations with respect to the first lock 2—i.e. rotational positions about the longitudinal axis of the first key shaft 212—and may, therefore, define a plurality of paths through which the first key 2 (or a part thereof) may pass.

The one or more plates 317 may include a third plate 317*c* which is configured to define the orientation of the first key 2 with respect to the first lock 3 when last removed from the first lock 3. Thus, this third plate 317*c* may be configured to rotate with the lock cylinder member 315 and define a single path through which the first key 2 (or a part thereof) may pass. The third plate 317*c* may be located between the second plate 317*b* and the internal face of the raised cylindrical portion 313 of the housing 312 of the first lock 3. The rotation of the third plate 317*c* may be caused by engagement of the third plate 317*c* with a part of the first key 2—such as the second key protrusion 212*b*.

Figure 15:
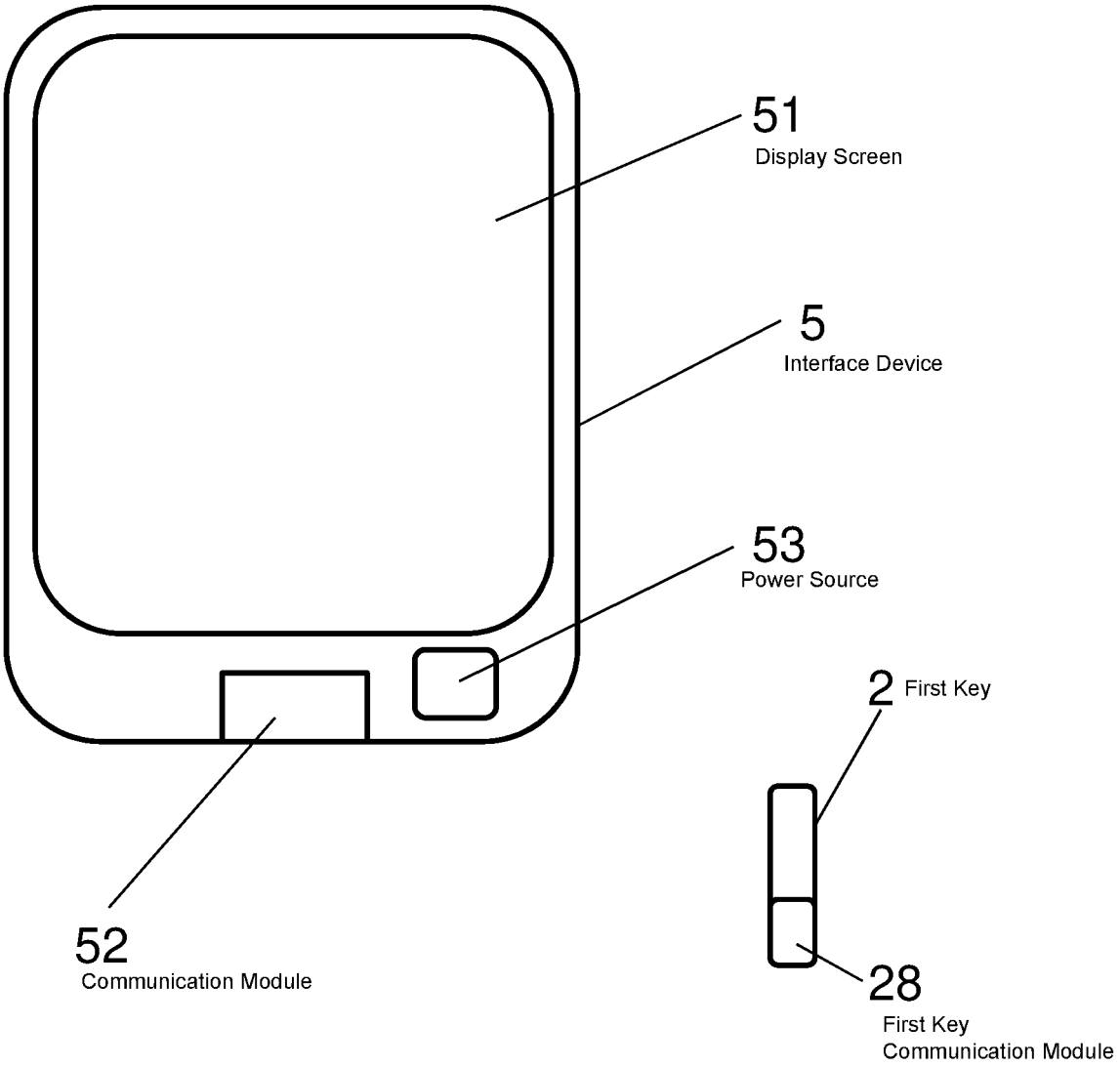
FIG. 15 shows a user interface device and key of some embodiments.

Some embodiments may further include a user interface device 5, see FIG. 15. The user interface device 5 may be a computing device—including, for example, a processor, memory, and the like. The user interface device 5 may be portable such that it can be carried manually.

The user interface device 5 may be communicatively coupled to the first key 2. This communicative coupling may be through a wired or wireless link provided by a communication module 52 of the user interface device 5. The first key 2 may include a first key communication module 28 which is configured to communicate with the communication module 52 of the user interface device 5 and this may use a different form of communication to the first key communication interface 22. The communication module 52 and first key communication module 28 may be a serial communication interface which may use the universal serial bus, and/or may be through an RS232 connector. The communication module 52 and first key communication module 28 may use a wireless protocol such as Bluetooth, NFC, Wi-Fi, or the like.

The communication module 52 may be configured to communicate with one or more other components of the interlock system 1 which may include one or more other user interface devices and/or one or more other keys and/or locks.

The user interface device 5 includes a display screen 51 which is configured to display information to an operator. This information may include, for example instructions to the operator regarding use of the first key 2. In a system in which there is a plurality of locks, then the information may include instructions as to which of the plurality of locks to actuate using the first key 2.

The user interface device 5 may be configured to receive one or more of the first key identifier, one or more virtual keys stored by the first key 2 in the first key memory 21, the condition of the first lock 3, and the whole or part of the first key whitelist 24, for example. These are examples of the data which may be received by the user interface device 5, this data may include any data held by the first key 2 or received by the first key 2 from the first lock 3.

The data which is passed from the first key 2 to the user interface device 5 may include information regarding a lock with which the first key 2 is currently engaged. This may include the first lock identifier for the lock with which the first key 2 is currently engaged. This may include indications of one or more virtual keys which are required to actuate the first lock 3 (i.e. the lock with which the first key 2 is engaged)—this may be the whole or part of the first lock whitelist 34, for example.

The user interface device 5 may be configured to determine whether the lock with which the user is currently attempting to engage the first key 2 (e.g. with the first key 2 in the communication position with respect to the lock) is the correct lock. The correct lock may be determined by checking whether the lock is configured to be actuated by the first key 2 based on one or more virtual keys held on the first key 2 or one or more virtual keys listed in the lock whitelist for that lock. In addition or alternatively, in some embodiments, the correct lock is determined by comparing the identifier for that lock with the expected identifier in accordance with a predefined lock sequence. The user interface device 5 may be configured to display, using the display screen 51, an indication of whether the lock is the correct lock. The correct lock and key may be determined using the same processes as described above for determining whether the first key 2 is moveable from the communication to the actuation position.

In some embodiments, the user interface device 5 is configured to receive one or more fault codes issued by the first key 2 or the first lock 3 (which may be configured to issue a fault code on detection of a fault). The user interface device 5 may be configured to alert the user to the fault by, for example, displaying an indicator on the display screen 51. The first key 2 and/or first lock 3 may, therefore, include a diagnostic function in which one or more faults can be detected and reported, for example.

In some embodiments, the user interface device 5 includes details of one or more user accounts—each account being associated with respective login details. Accordingly, the operational history of one or both of the user interface device 5 and/or the first key 2 may be associated with a user account for the user logged in when the relevant event or events occurred. In this instance, an event may include any data received by or determined by the user interface device 5 (this may include which lock a particular key has been used with and when, and/or which keys have operated a particular lock and when). The user interface device 5 may include, accordingly, an archive which includes details of its operation and/or the operation of one or more keys and/or locks associated therewith. This archive may be transmitted (e.g. using the communication module 52) to another part of the interlock system 1.

The user interface device 5 may be configured to display, using the display screen 51, one or more sequences of operation—i.e. one or more sequences of lock with which the first key 2 must be operated. The or each sequence may be determined by the user interface device 5, input by a user, and/or received by the user interface device 5 from another part of the interlock system 1.

In some embodiments, the user interface device 5 includes a power source 53 which may be in the form of a battery or a connection to an electrical supply. In some embodiments, the power source 53 of the user interface device 5 is also the external power supply for the first key 2—and may be connected to the power supply 219.

In some embodiments, data stored on the first key 2 and/or first lock 3 and/or user interface device 5 may be encrypted. This may include the or each virtual key and/or identifier for the first key 2 and/or the first lock 3.

In some embodiments, one or more components of the first key 2 and/or first lock 3 and/or user interface device 5 may be duplicated in order to provide redundancy. During operation, each duplicate component may be mirrored—i.e. changes thereto are duplicated across the duplicate components.

Figure 16:
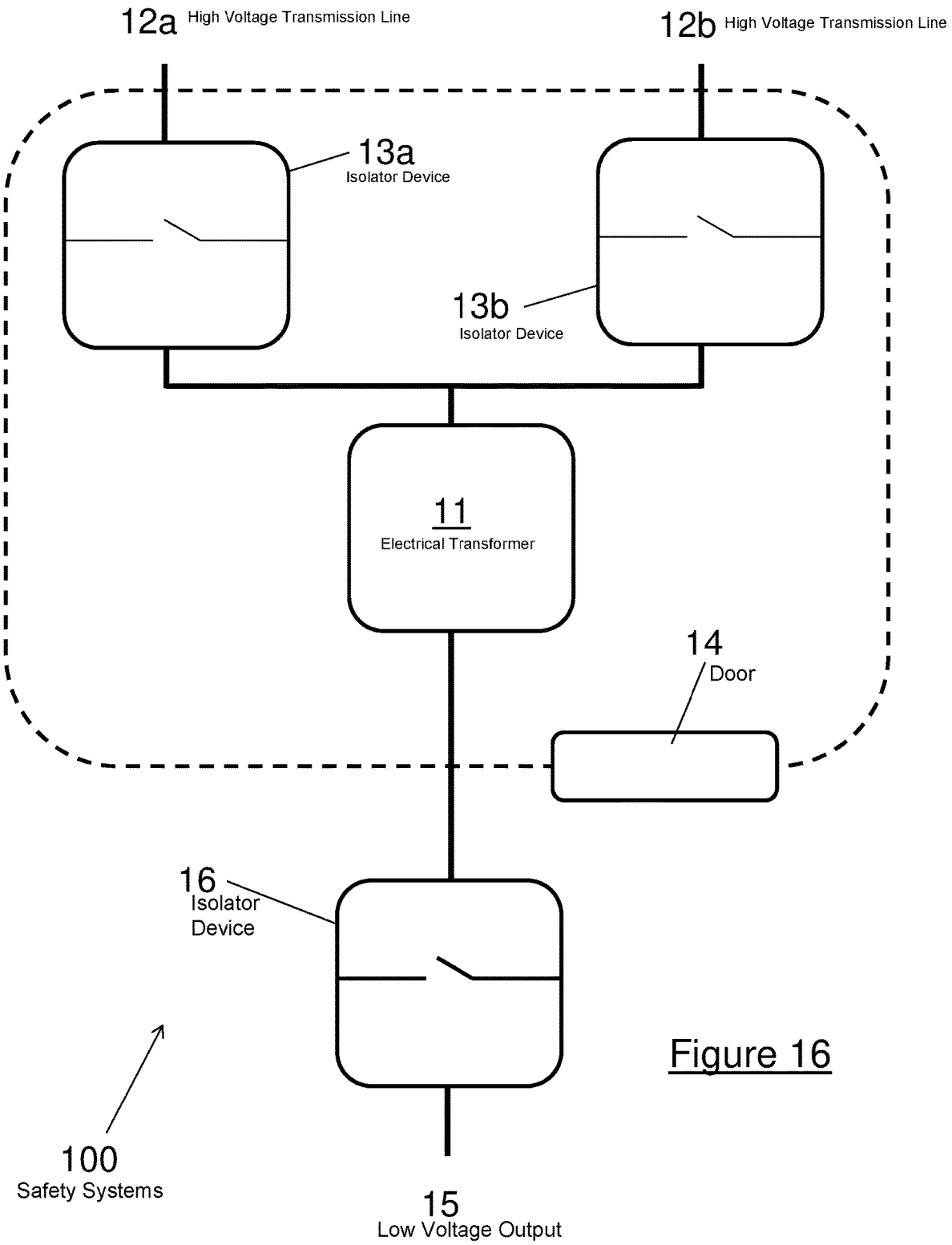
FIG. 16 shows a safety system of some embodiments.

An operational example implementation of some embodiments of the present invention is described with reference to FIG. 16.

In this example, an interlock system 1 is provided. This system 1 is configured for use with—merely by way of an example—an electrical transformer 11. The electrical transformer 11 is one example of a potentially dangerous item of equipment with which embodiments of the present invention may be used.

The electrical transformer 11 is configured to receive electricity of a high voltage from one of two available high voltage transmission lines 12*a*,12*b*. Each of the high voltage transmission lines 12*a*,12*b* is associated with a respective isolator device 13*a*,13*b*. The electrical transformer 11 should be connected only to one of the two high voltage transmission lines 12*a*,12*b* at a time and the isolator devices 13*a*,13*b* act to connect or disconnect each high voltage transmission line 12*a*,12*b* from electrical communication with the electrical transformer 11.

The electrical transformer 11 is provided, in this example system 1, within an enclosure having a door 14. Operation of a lock of the door 14 is controlled by the interlock system 1.

An output from the electrical transformer 11 is a low voltage output line 15 which may be connected in electrical communication with equipment forming an electrical load. The electrical load can be disconnected from the electrical transformer 11 by an output isolator device 16.

The correct sequence of operation to gain access to the electrical transformer 11 (e.g. for maintenance or inspection) is to actuate the output isolator device 16 to disconnect the electrical load from the electrical transformer 11, to actuate the isolator devices 13*a,b* to disconnect the high voltage transmission lines 12*a,b* from the electrical transformer 11, and only then to allow the door 14 to be unlocked so that it can be opened.

As will be understood from the above, only one of the isolator devices 13*a,b* is to be in its on state at any one time—the other isolator device 13*a,b* being in its off state to avoid both high voltage transmission lines 12*a,b* being connected to the electrical transformer 11 at the same time.

Accordingly, actuation of the first and second isolator devices 13*a,b* may be achieved using respective locks of the same type as the first lock 3. Both of these locks 3 are configured to require a first virtual key in order to actuate the isolator device 13*a,b* from the off to the on state. So, for example, in normal operation, that first virtual key may be stored in the first lock memory 31 of the lock 3 associated with the first isolator device 13*a* which is in the on state. There is only one first virtual key in this system 1 and so the lock associated with the second isolator device 13*b* must be in a condition such that the second isolator device 13*b* is in its off state.

An operator may wish to change which of the two high voltage transmission lines 12*a,b* provides electricity to the electrical transformer 11. In some embodiments, the operator may enter this wish into the user interface device 5 which may then display instructions for the operator to follow.

The operator may take the first key 2 and engage that first key 2 with the lock 3 associated with the first isolator device 13*a*. The first key 2 may be recognized as authorized and, after initial placement in the communication position, may move to the actuation position. The first key 2 can then be operated to actuate that lock 3 to change the condition of the lock 3 to actuate the first isolator device 13*a* to its off state. This process also results in the transfer for the first virtual key from the lock memory 31 of that lock 3 to the first key memory 21.

The first key 2 can then be removed from that lock 3 and engaged with the lock 3 associated with the second isolator device 13*b*. Again, the first key 2 is recognized as authorized and moves from the communication position to the actuation position. The operator can now use the first key 2 to actuate that lock 3 to change its condition and to actuate the second isolator device 13*b* to its on state. This process also transfers the first virtual key from the first key memory 21 to the lock memory 31 of that lock 3.

The operator may wish to access the electrical transformer 11 for maintenance or inspection, for example. As a result, the operator may need to open the door 14. The operator, again, may enter this wish into the user interface device 5 which may display instructions for the operator to follow.

The operator may use the first key 2 in conjunction with the lock 3 associated with the output isolator device 16 to disconnect the low voltage output line from electrical communication with the electrical transformer. The output isolator device 16 in its normal on state, the lock memory 31 of the associated lock 3 may store a second virtual key. Therefore, the operator can use the first key 2 to collect the second virtual key from that lock 3 by moving the first key 2 to the communication position with respect to that lock 3. As the first key 2 is authorized, the first key 2 then moves to the actuation position at which the operator can actuate the lock 3 to change its condition and actuate the output isolator device 16 to its off state. This process also results in the transfer of the second virtual key from that lock 3 to the first key memory 21.

The operator will need to identify the isolator device 13*a,b* which is currently in its on state. The user interface device 5 may, for example, display this information on the display screen 51 thereof. The operator can then use the first key 2 (as described above) to collect the first virtual key from the lock 3 associated with the isolator device 13*a,b* which was in the on state. This will actuate that lock 3 to a different condition and the associated isolator device 13*a,b* to its off state. Thus, both isolator devices 13*a,b* are in their respective off states.

The first key memory 21 now stores both the first and second virtual keys.

The lock 3 associated with the door 14 may be such that it requires both the first and second virtual keys in order to change its condition and to actuate the lock to an unlocked state (from the normal locked state). As the first key 2 now has both of these virtual keys it may be moved to the communication position with respect to that lock. The first key 2, being authorized, is then moveable to the actuation position such that the operator can use the first key 2 to change the condition of that lock and unlock the door 14. The first and second virtual keys are, as a result, transferred to the lock memory 31 of the lock 3 associated with the door 14.

Accordingly, the use of the virtual keys in this example prevents the operator from unlocking and opening the door 14 until both of the virtual keys have been retrieved from the locks 3 associated with their respective isolator devices 13*a*,13*b*,16 and all isolator devices 13*a*,13*b*,16 must be in their off states.

The process is repeated in reverse order after the operator has completed their task and wishes to re-enable the electrical transformer 11.

As will be appreciated, the same first key 2 may be used with a plurality of different first locks 3 in accordance with embodiment of the present invention, with one or more virtual keys providing the trapped key functionality. It will also be appreciated that multiple first keys 2 may be used with one or more first locks 3.

In some embodiments, the first key communication interface 22 and first lock communication interface 32 may be configured such that they cannot communicate (e.g. due to limited communication range) when the first key 2 is not in the communication or actuation position with respect to the first lock 3.

In some embodiments, the first key shaft 212 is keyed, mechanically, so that it will only operate with a subset of locks (the subset may include a single first lock 3). This enables additional safety and security in some instances. In some embodiments, however, this is not required and there may be a plurality of keys which are mechanically configured to engage the first lock 3 but which are prevented from doing so if not permitted to be moved from the communication to the actuation position with respect to the first lock 3—as described herein. This enables keys to be, in effect, programmed for use without any expensive key cutting process to provide the correct mechanical keying.

Embodiments have been described in relation to the exchange of one or more virtual keys which may include a transfer via a move or a copy operation. In some embodiments, for example those using a copy operation, rather than moving a virtual key, the first key 2 and/or first lock 3 may use a check-in and check-out operation to handle the or each virtual key. Accordingly, each of the first lock and first key whitelists 24,34 may include a check-in and check-out indication. A virtual key may, therefore, be checked-out from the first key 2 and consequentially be checked-in to the first lock 3 and vice versa. The check-in and check-out indication may be a parameter which indicates whether a particular virtual key is checked-in or checked-out. A checked-out virtual key cannot, in some embodiments, be re-checked-out. Therefore, the effect of checking in and out virtual keys is comparable to the transfer of the virtual keys by the move operation.

Actuators 4 have been described in general and some examples have been provided (e.g. the lock 3 associated with the door 14, and the isolator devices 13*a,b*,16). The actuators 4 may come in many different forms and these are just examples of possible actuators 4.

As will be appreciated, and as mentioned above, references to keys and locks herein are typically references to keys and locks having features and functionality of the example first key 2 and first lock 3 described herein.

Embodiments of the present invention include a safety system 100 which may include the interlock system 1 described herein and/or any part thereof and/or one or more actuators 4 (which may or may not be viewed as part of the interlock system 1). Embodiments of the present invention may also include methods of operating interlock systems 1 and safety systems 100 as described herein and as would be apparent from the description of the features of the interlock systems 1 and/or safety systems 100 of embodiments.

As will be appreciated, embodiments of the present invention may provide guidance for the user, via the user interface device 5, to ensure correct and/or efficient operation of the interlock system 1 and/or safety system 100.

The mechanical engagement of the first lock 3 and first key 2 ensures that accepted safety standards and equipment can continue to be used with embodiments of the invention.

The provision, in some embodiments, of a single key 2 which can actuate a plurality of different locks using virtual keys to ensure correct operation, means that the need for the user to carry, organize and use a plurality of different keys is reduced.

The use of virtual keys also allows for greater logging of operations of the interlock system 1 and/or safety system 100 in some embodiments.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. An interlock system comprising:

a first lock including a first lock memory configured to store one or more virtual keys; and a first key including a first key memory configured to store a virtual key of the one or more virtual keys, wherein the first lock is configured to be actuated between a first condition and a second condition, when a first virtual key stored in the first key memory is transferred to the first lock memory by either, a move operation, comprising movement of the virtual key such that the virtual key is only stored in one of the first key memory and the first lock memory but not both, once the move operation is complete, or a copy operation in which the first lock includes a first lock whitelist and the first key includes a first key whitelist and the virtual key is stored in both the first key memory and the first lock memory, once the copy operation is complete, the copy operation further including each of the first lock whitelist and the first key whitelist including a parameter that indicates whether a particular virtual key of the one or more virtual keys is checked-in or checked-out and wherein a checked-out virtual key cannot be re-checked-out, such that the first virtual key is checked out from the first key and consequentially is checked-in to the first lock, the first lock being configured to be actuated by engagement of the first key and the first lock, and movement of the first key with respect to the first lock, such that the transfer of the virtual key and the engagement of the first key enforces a specific sequence of operations.

2. An interlock system according to claim 1, wherein:

the first key includes a key shaft and a key head, and the first lock defines a key receiving aperture, wherein the key receiving aperture is configured to receive at least a portion of the key shaft of the first key.

3. The interlock system according to claim 1, wherein the first key is positionable with respect to the first lock in:

(i) a communication position, in which the first virtual key is transferrable from the first key memory to the first lock memory and actuation of the first lock between the first and second conditions is substantially prevented; and (ii) an actuation position, in which the first key is engaged with and moveable with respect to the first lock to actuate the first lock between the first and second conditions.

4. The interlock system according to claim 3, wherein the first key includes an engagement release mechanism which is configured to operate to control whether the first key is positionable in the actuation position.

5. The interlock system according to claim 4, wherein the engagement release mechanism is configured to operate to allow positioning of the first key in the actuation position when the first virtual key is transferred to the first lock memory.

6. The interlock system according to claim 4, wherein the engagement release mechanism includes a pin located within pin receiving hole of first key.

7. The interlock system according to claim 1, wherein the first key includes a collar which is configured to fit around at least part of a housing of the first lock.

8. The interlock system according to claim 1, further including a second lock, wherein the second lock:

includes a second lock memory; and is configured to be actuated between a first condition and a second condition, when a first virtual key stored in the first key memory is transferred to the second lock memory, by engagement of the first key and second lock, and movement of the first key with respect to the second lock.

9. The interlock system according to claim 1, further including an actuator coupled to the first lock such that actuation of the first lock between the first and second conditions causes actuation of the actuator between first and second states.

10. The interlock system according to claim 1 further including one or more actuators configured to be controlled by the first lock.

11. An interlock key system including an interlock key, which includes:

a first key memory configured to store one or more virtual keys, a communication interface configured to transfer a virtual key of the one or more virtual keys from the first key memory to a first lock memory on a first lock, by either, a move operation, comprising movement of the virtual key such that the virtual key is only stored in one of the first key memory and the first lock memory but not both, once the move operation is complete, or a copy operation in which the first lock includes a first lock whitelist and the interlock key includes a first key whitelist, the virtual key is stored in both the first key memory and the first lock memory, once the copy operation is complete, the copy operation further including each of the first lock whitelist and the first key whitelist including a parameter that indicates whether a particular virtual key of the one or more virtual keys is checked-in or checked-out and wherein a checked-out virtual key cannot be re-checked-out, such that the first virtual key is checked out from the interlock key and consequentially is checked-in to the first lock, and a key shaft configured to engage the first lock to actuate the first lock between a first condition and a second condition by movement of the interlock key with respect to the first lock, such that the transfer of the virtual key and the engagement of the interlock key enforces a specific sequence of operations.

12. The interlock key system according to claim 11, wherein the interlock key further comprises an engagement release mechanism which is configured, in a first state, to prevent substantially the actuation of the first lock between the first and second conditions and, in a second state, to allow the actuation of the first lock between the first and second conditions.

13. The interlock key system according to claim 12, wherein the engagement release mechanism is configured to adopt the second condition on detection by the interlock key that the interlock key is the correct key for the first lock.

14. The interlock key system according to claim 11 further including one or more actuators configured to be controlled by the first lock.

15. The interlock key system according to claim 11 including a user interface device communicatively coupled to the interlock key.

16. The interlock key system according to claim 15, further comprising a display screen configured to provide a user with an indication of a sequence of one or more locks to be actuated by the interlock key.

17. An interlock lock including:

a first lock memory configured to store one or more virtual keys, a communication interface configured to receive the one or more virtual keys from a first key memory, by either:

a move operation, comprising movement of a virtual key of the one or more virtual keys such that the virtual key is only stored in one of the first key memory and the first lock memory but not both, once the move operation is complete, or a copy operation in which the interlock lock including a first lock whitelist and a first key including a first key whitelist, wherein the virtual key is stored in both the first key memory and the first lock memory once the copy operation is complete, the copy operation further includes each of the first lock whitelist and the first key whitelist including a parameter that indicates whether a particular virtual key of the one or more virtual keys is checked-in or checked-out, and a checked-out virtual key cannot be re-checked-out, such that the first virtual key is checked out from the first key and consequentially is checked-in to the interlock lock, and a key receiving aperture configured to receive at least a portion of the first key to actuate the interlock lock between a first condition and a second condition by movement of the first key with respect to a first lock, such that the transfer of the virtual key and the engagement of the first key enforces a specific sequence of operations.

18. An interlock lock according to claim 17, wherein the lock memory and communication interface are passive such that they operate using electrical power generated by the interlock lock from a received electromagnetic signal.

19. The interlock lock according to claim 17 further including one or more actuators configured to be controlled by the interlock lock.

* * * * *